US005733105A

United States Patent [19]

Beckett et al.

[11] Patent Number: 5,733,105

[45] Date of Patent: Mar. 31, 1998

[54] AXIAL CAM DRIVEN VALVE ARRANGEMENT FOR AN AXIAL CAM DRIVEN PARALLEL PISTON PUMP SYSTEM

[75] Inventors: Carl D. Beckett, Vancouver; Kevin D. O'Hara, Washougal, both of Wash.; Daniel B. Olsen, Fort Collins, Colo.; Steven E. Soar; Glenn E. Siemer, both of Vancouver, Wash.

[73] Assignee: Micropump, Inc., Vancouver, Wash.

[21] Appl. No.: 618,367

[22] Filed: Mar. 19, 1996

Related U.S. Application Data

[63] Continuation-in-part of Ser. No. 406,399, Mar. 20, 1995, abandoned, and Ser. No. 407,405, Mar. 20, 1995.

[51] Int. Cl.[6] ..... F04B 1/12

[52] U.S. Cl. ..... 417/269; 417/516; 137/625.21; 137/625.69; 91/503

[58] Field of Search ..... 417/269, 515, 417/516, 517, 518, 519; 137/625.21, 625.69; 91/499, 503

[56] References Cited

U.S. PATENT DOCUMENTS

| | | | |
|---|---|---|---|
| 646,024 | 3/1900 | Goodhart | 91/499 |
| 1,723,874 | 8/1929 | Lunge . | |
| 2,010,377 | 8/1935 | Sassen . | |
| 2,225,788 | 12/1940 | Mc Intyre | 417/269 |
| 2,397,594 | 4/1946 | Buchanan | 91/503 |
| 2,458,294 | 1/1949 | Parker . | |
| 2,600,099 | 6/1952 | Detrez . | |
| 2,745,350 | 5/1956 | Capsek | 417/516 |
| 3,016,837 | 1/1962 | Olugos . | |
| 3,272,079 | 9/1966 | Bent | 91/499 |
| 3,702,143 | 11/1972 | Van Wagenen et al. . | |
| 3,816,029 | 6/1974 | Bowen et al. . | |
| 3,823,557 | 7/1974 | Van Wagenen et al. | 91/499 |
| 4,028,018 | 6/1977 | Audsley . | |
| 4,233,002 | 11/1980 | Birenbaum . | |
| 4,359,312 | 11/1982 | Funke et al. . | |
| 4,432,310 | 2/1984 | Waller | 417/269 |
| 4,436,230 | 3/1984 | Hofmann . | |
| 4,556,371 | 12/1985 | Post . | |
| 4,687,426 | 8/1987 | Yoshimura . | |
| 5,230,610 | 7/1993 | Reichenmiller . | |

FOREIGN PATENT DOCUMENTS

| | | | |
|---|---|---|---|
| 0 172 780 | 6/1984 | European Pat. Off. . | |
| 658937 | 3/1938 | Germany | 91/499 |
| 566020 | 8/1977 | U.S.S.R. | 91/503 |
| 768330 | 2/1957 | United Kingdom | 91/499 |

*Primary Examiner*—Timothy Thorpe
*Assistant Examiner*—Cheryl J. Tyler
*Attorney, Agent, or Firm*—Klarquist Sparkman Campbell Leigh Whinston LLP

[57] ABSTRACT

A reciprocating piston pump provides pulseless delivery of liquid. It is suitable for use in compact environments or for the delivery of small amounts of liquid, as in chromatographic analysis devices. The pump includes two pistons with pumping chambers that are alternately connected to inflow and outflow lines through a control valve. The control valve moves between a first position in which inflow is directed to the first piston chamber and outflow to the second piston chamber, and a second position in which outflow is directed to the first piston chamber and inflow is directed to the second piston chamber. Each outflow pulse from the piston is sustained longer than each inflow pulse, and the outflow pulses are staggered and partially superimposed to provide substantially pulseless delivery of liquid from the pump. A rotating cam moves the pistons of the pumps and the control valve between their operating positions described above. The cam rotates at a constant speed around an axis that is parallel to the axis of movement of the piston pumps. A control surface is carried by and rotated by the cam in one embodiment. Grooves inscribed in the control surface establish and break fluid connections as the cam rotates.

28 Claims, 8 Drawing Sheets

AXIAL CAM DRIVEN VALVE ARRANGEMENT FOR AN AXIAL CAM DRIVEN PARALLEL PISTON PUMP SYSTEM

CROSS REFERENCE TO RELATED CASES

This is a Continuation-in-Part of U.S. patent application Ser. No. 08/406,399 filed Mar. 20, 1995 now abandoned, and U.S. patent application Ser. No. 08/407,405 also filed Mar. 20, 1995 now allowed.

BACKGROUND OF THE INVENTION

1. Field of the Invention

This invention concerns a reciprocating piston pump that provides substantially pulseless delivery of a liquid. This pump is particularly suited for supplying liquids used in chromatographic analysis devices, where pulseless flow at low flow rates (0.2–1 ml/min) is required to achieve high instrument sensitivity.

2. General Description of the Background

Constant volume, pulseless reciprocating pumps have been disclosed in U.S. Pat. Nos. 3,816,029; 4,028,018; 4,687,426 and 4,556,371. A piston pump using a spool valve to control liquid outlet from the pistons is similarly shown in European Patent No. A20 172 780.

Pulseless delivery of a liquid is described in detail in U.S. Pat. No. 4,359,312, which discloses a reciprocating piston pump with two pistons connected in parallel on the discharge side. One of the pistons draws in fluid while the other is delivering fluid. The pistons are controlled by a cam, which is in turn operated by a computer program to compensate for the compressibility of liquid in the pump. The rotational speed of the cam is varied to compensate for the compressibility of liquid in the pump and achieve a constant pump output.

U.S. Pat. No. 2,010,377 describes a dual piston pump that achieves non-pulsating fluid output by overlapping the power strokes of each piston in the pump, and controlling the volumetric displacement of the pump per cycle. The combined delivery of the two pistons, per unit time, is substantially constant or non-fluctuating.

Each of the pumps shown in the patents described above is relatively large and not well adapted for pumping and delivering very small amounts of liquid at a constant flow rate, as required in chromatographic analyzers. The prior pumps are particularly unsuitable for placement in a compact pumping assembly. Some of these previous pumps also suffer from the disadvantage of requiring complicated computer programs and automated control mechanisms to achieve constant pump output.

It is accordingly an object of the present invention to provide a multiple piston pump that is compact and suitable for delivery of very small amounts of liquid.

It is yet another object of this invention to provide such a pump that is compact.

Finally, it is an object of the invention to provide a piston pump that is simpler in operation than some previous pumps, and particularly is free of the necessity for complex mechanical or computer-assisted operation to provide pulseless delivery of liquid (although such mechanical or computer-assisted operation can be used with the present invention).

SUMMARY OF THE INVENTION

The foregoing objects are achieved in one embodiment of the present invention by providing a pump having at least a first and second piston, wherein the first piston communicates with a first pumping chamber and the second piston communicates with a second pumping chamber. An inlet flow path communicates with the first pumping chamber when the first piston is reciprocating in a direction that draws fluid into the first pumping chamber, and with the second pumping chamber when the second piston is reciprocating in a direction that draws fluid into the second pumping chamber. An outlet flow path communicates with the first pumping chamber when the first piston is reciprocating in a direction that expels fluid out of the first pumping chamber, and with the second pumping chamber when the second piston is reciprocating in a direction that expels fluid out of the second pumping chamber.

A control valve alternately moves between a first position and a second position, such that when the control valve is in the first position the inlet flow path to the first pumping chamber is continuous and the outlet flow path from the first pumping chamber is interrupted, and the inlet flow path to the second pumping chamber is interrupted and the outlet flow path form the second pumping chamber is continuous. When the control valve is in the second position, the inlet flow path to the second pumping chamber is continuous and the outlet flow path from the second pumping chamber is interrupted, and the inlet flow path to the first pumping chamber is interrupted and the outlet flow path from the first pumping chamber is continuous. The control valve preferably includes grooves inscribed in the control surface that establish and break fluid connections as the cam rotates.

Each reciprocating piston is reciprocated by a cam having a bearing surface that rotates around an axis that is substantially parallel to the pistons. The bearing surface has a variable shape that reciprocates the pistons, which are spring biased against the bearing surface. The variable shape of the bearing surface may be provided by a raceway in the cam, or a slanted surface with a constant slope. In particularly preferred embodiments, the bearing surface surrounds the control surface, and both are rotated at the same rotational velocity by the cam.

In another particular embodiment, the pump includes a plurality of reciprocating pistons, wherein each piston communicates with a pumping chamber to draw fluid into the pumping chamber as the piston moves in a first direction, and to force fluid out of the pumping chamber as the piston moves in a second direction. An inlet flow path delivers fluid to the pump, and an outlet flow path delivers fluid from the pump. A rotary cam rotates around an axis of rotation and reciprocates the pistons as the cam rotates.

A control surface carried by the cam has flow channels inscribed therein. One of the flow control channels is a continuous annular outer channel. Another channel is a discontinuous annular inner channel circumscribed by the outer continuous annular channel. The inner channel has a first arc shaped portion and a second arc shaped portion that do not communicate with each other. A localized indentation is provided at the center of rotation of the cam. A first communicating channel extends between the localized indentation and the first arc shaped inner channel portion. A second communicating channel extends between the outer channel and the second arc shaped inner channel portion.

A stationary control plate fits against the control surface to form closed passageways between the control plate and the channels in the control surface. The control plate has a first opening through the control plate positioned in alignment with the continuous annular outer channel as that channel rotates on the cam. The first opening establishes fluid communication between the annular outer channel and the inlet flow pathway. A second opening through the control plate is positioned in alignment over the local surface indentation at the axis of rotation of the control surface. The second opening establishes fluid communication with the outlet flow pathway. A plurality of pumping chamber openings through the control plate are positioned on a common circle to establish fluid communication between the pumping chamber flow paths and the discontinuous annular inner channel on the control surface.

In yet another embodiment, a multiple piston pump has a housing containing at least first and second spring-biased pump piston assemblies. The first pump piston assembly includes a first elongated piston bore with a reciprocating piston disposed therein, and an enlarged volume area in the first piston bore that forms a first pumping chamber. The second pump piston assembly similarly includes a second elongated piston bore with a second reciprocating piston disposed in the second piston bore, and an enlarged volume area in the second piston bore that forms a second pumping chamber. The enlarged volume area in each piston bore is provided, in one embodiment, by a step or diameter transition, and volumetric displacement is proportional to the differential piston area at the step.

An inlet flow path is provided through the housing that communicates with the first pumping chamber when the first piston is reciprocating in a direction that draws fluid into the first pumping chamber. The inlet flow path alternately communicates with the second pumping chamber when the second piston is reciprocating in a direction that draws fluid into the second pumping chamber. An outlet flow path is also provided through the housing to communicate with the first pumping chamber when the first piston is reciprocating in a direction that expels fluid out of the first pumping chamber. The outlet flow path alternately communicates with the second pumping chamber when the second piston is reciprocating in a direction that expels fluid out of the second pumping chamber.

The bore axes for the two piston bores are substantially parallel, and each reciprocating piston is reciprocated by a cam that rotates about an axis parallel to the bore axes. The cam moves the first and second pistons in such a manner that the first piston expels fluid while the second piston draws fluid in, and the first piston draws in fluid while the second piston expels fluid. Hence, the pistons are 180 degrees out of phase. The cam further moves the control valve between the first and second positions, with the control valve in the first position during the period in which the first piston draws in fluid and the second piston expels fluid. The control valve is moved to assume the second position when the first piston expels fluid and the second piston draws in fluid.

It is a particular advantage of some embodiments of the present invention that the cam has an impingement surface that impinges the pistons, and reciprocates them in such a manner that fluid delivery from the pump is substantially constant. Such constant fluid delivery is achieved by providing an impingement surface on the cam that alternately displaces each piston in a positive displacement direction away from a neutral position to create a positive pressure that expels fluid from the pumping chamber. Such positive displacement of each piston is followed by a reversal of piston direction to a negative displacement direction, which creates a negative pressure that draws fluid into each pumping chamber. The period of time during which negative displacement of each piston occurs is less than the period of time during which positive displacement of each piston occurs. Moreover, the positive displacements of the first and second pistons are in staggered phases, such that the output flows of the first and second piston pumps are superimposed to provide a substantially continuous fluid flow from the pump.

DETAILED DESCRIPTION OF SEVERAL PREFERRED EMBODIMENTS

Figure 3:
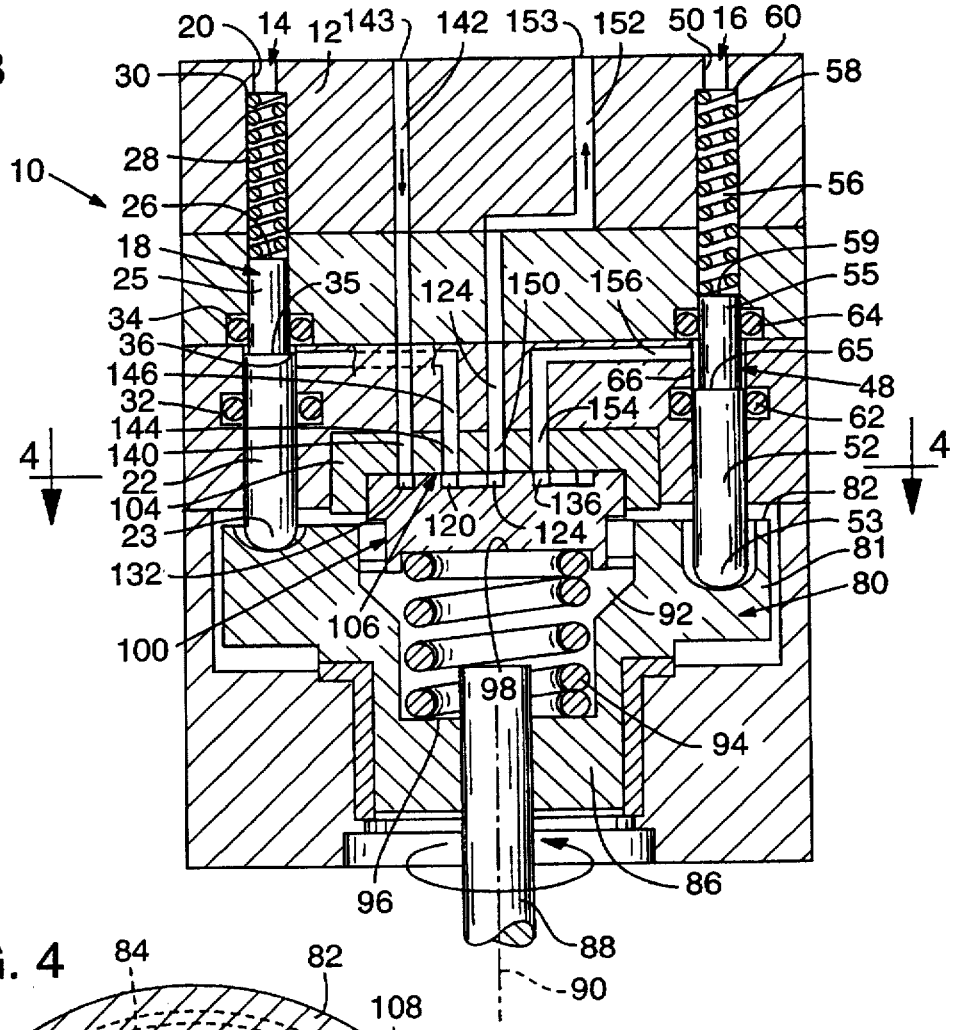
FIG. 3 is a cross-sectional view through a first embodiment of the piston pump of the present invention.

A dual piston pump 10, shown in FIG. 3, is capable of substantially pulseless delivery of a fluid, such as liquid water. The pump includes a housing 12 that contains first pump piston assembly 14 and second pump piston assembly 16. First assembly 14 includes a reciprocating first piston 18 in a first piston bore 20 that extends from an upper surface of housing 12. Piston 18 has a large diameter portion 22 that fits Within a correspondingly enlarged diameter portion of bore 20. The piston has a rounded bearing tip 23 that extends into a cam chamber 24 to engage a cam bearing surface.

Piston 18 also includes a reduced diameter portion 25 with an upper spring seat surface 26, that fits within a reduced diameter portion of bore 20. Piston 18 is capable of reciprocating in bore 20 against the bias of a helical spring 28 with an upper end that seats against an internal shoulder 30 of bore 20, and spring 28 extends through bore 20 to sit on a flat upper face 26 of portion 25 of piston 18.

A pair of parallel, spaced, annular seals 32, 34 are placed around piston 18 with seal 32 circumscribing portion 22, and seal 34 circumscribing portion 25 slightly above an annular face 35 between portions 22, 25 of piston 18. A first pumping chamber 36 is formed in the bore 20 by the necked down portion of piston 18, and extends from seal 34 to the annular face 35. Chamber 36 is shown in a compressed condition in FIG. 3, but the chamber expands as piston 18 is forced downwardly by spring 30, and the expanding chamber creates a suction pressure that draws liquid into the chamber in a manner described below.

Second assembly 16 is similar to assembly 14 described above. Second assembly 16 includes a reciprocating piston 48 in second piston bore 50 that extends from an upper surface of housing 12 through to cam chamber 24, where it abuts a cam raceway described below. Piston 48 has a large diameter portion 52 that fits within a correspondingly enlarged diameter portion of bore 50. The piston has a rounded bearing tip 53 that extends into cam chamber 24. Piston 48 also has a reduced diameter portion 55. Piston 48 is capable of reciprocating in bore 50 against the bias of a helical spring 58 that seats on an internal shoulder 60 of bore 50 and extends through bore 50 to also seat on a flat upper face 59 that forms the top surface of portion 55 of piston 48.

A pair of parallel, spaced, seals 62, 64 are placed around piston 48 with seal 62 circumscribing portion 52, and seal 64 circumscribing portion 55 slightly above an annular face 65 between portions 52, 55 of piston 48. A pumping chamber 66 is formed in the bore 50 by the necked down portion of piston 48. Chamber 66 extends from seal 64 to annular face 65. Chamber 66 is shown in a fully expanded condition in FIG. 3, with piston 48 displaced completely downward by the expansion of spring 58 and the changing surface of the cam described below. The volume of chamber 66 will diminish as piston 48 is subsequently moved upwardly, which will create a positive pressure in chamber 66 as its volume is reduced.

Large diameter portions 22, 52 of pistons 18, 48 extend into cam chamber 24 to contact a raceway 84 of cam 80. The cam moves at a constant rotational speed and has a surface that impinges against the pistons 18, 48 to reciprocate them against the bias of their respective springs 28, 58. Cam 80 includes a cylindrical cam collar 81 having a flat upper bearing surface 82 (FIGS. 3 and 4) with a continuous annular cam raceway 84 having a center of curvature at the axis of rotation of the cam. The bearing tips 23, 53 of pistons 18, 48 abut against and ride within the groove 84, and are maintained in contact therewith by the bias of springs 28, 58. Raceway 84 has a varying depth, described further below, which moves pistons 18, 48 against the bias of springs 28, 58 to stagger the pulsatile outflow from each of piston assemblies 14, 16 and achieve substantially continuous liquid outflow from pump 10.

Figure 4:
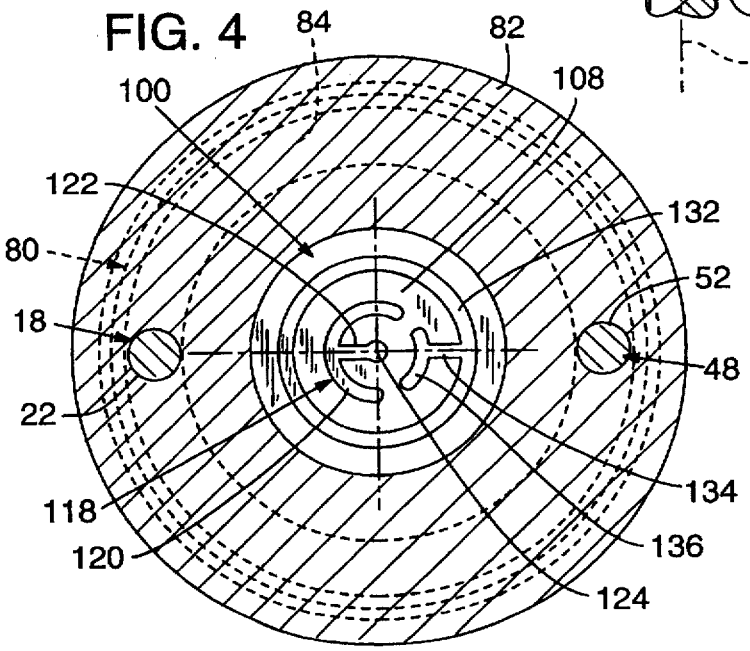
FIG. 4 is a view of the cam and control valve for the piston pump, taken along lines 4—4 of FIG. 3, with the position of control valve passageways shown on the cam.
Figure 5:
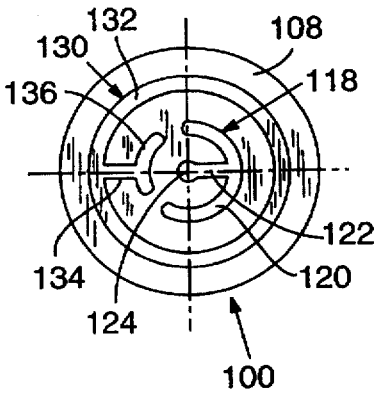
FIG. 5 is a view of the control valve portion of FIG. 4, showing the position of the control valve passageways after the control valve has rotated through a 180 degree rotation from the position shown in FIG. 4.

Cam 80 further includes a downwardly extending annular bearing collar 86 through which a drive shaft 88 extends. Shaft 88 is fixed to collar 86 to rotate cam 80 as shaft 88 rotates. Shaft 88 extends along the axis of rotation 90 of collars 81, 86, and the axis 90 is substantially parallel to the longitudinal axes of bores 20, 50. An interior spring chamber 92 of cam 80 contains a helical spring 94 that is seated on annular surface 96 around shaft 88. Spring 94 extends upwardly around a portion of shaft 88 and toward a flat bearing face 98 of a control valve 100 (FIGS. 3–5), to support the control valve. Control valve 100 is carried by cam 80 and rotates with collar 81. A wear plate 104 is fixed to housing 12, does not rotate with cam 80, and has an internal bearing surface 106 (FIG. 3) that bears against opposing bearing surface 82 (FIGS. 4–5).

Bearing surface 108, on the upper surface of control valve 100, acts as a control surface that has a series of grooves inscribed thereon that, in cooperation with the overlying stationary plate 104, form enclosed passageways that direct the flow of fluid through the control valve 100. A first groove complex 118 is generally epsilon-shaped, with an arcuate back 120 and a straight cross portion 122 that extends toward and terminates at an axis of rotation 124 of the control valve 100 (which is coincident with the axis of rotation 90). The portion of the passageway at the axis of rotation 124 is enlarged (compared to the width of the remainder of groove complex 118) and cylindrical or hemispherical. Arcuate back 120 falls on a portion of a circle that has a center of curvature at axis 124.

A second groove complex 130 is also inscribed into surface 108. Complex 130 includes an annular groove 132 that circumscribes first groove complex 118, and has the same center of curvature as arcuate back 120, but a greater radius of curvature. A side-arm groove 134 extends from groove 132, toward axis 124, but stops short of reaching it. Groove 134 terminates in an arcuate groove 136 that is on the same circle as arcuate back 120, but does not overlap groove 120. Groove 136 has the same center of curvature and radius of curvature as groove 120. Each of groove complexes 118, 130 are covered by internal bearing surface 106 of wear plate 104, which forms a fluid tight seal with the grooves, such that the groove complexes 118, 130 and bearing surface 106 form fluid passageways of the same configuration as the grooves described above.

An inlet bore 140 extends through plate 104 from the internal surface 106 thereof, and the distance from axis 124 to groove 132 is the same as the radius of the circle formed by groove 132. Hence, bore 140 communicates with the passageway formed by annular groove 132 at all times during the rotation of cam 80. Bore 140 also communicates with an inlet flow path line 142 that extends through housing 12 to the exterior thereof, for connection through an orifice 143 to a source of liquid (not shown) that is to be pumped through pump 10.

A first pumping chamber bore 144 also extends through plate 104, with the distance from axis 124 to bore 144 the same as the radius of the circle on which grooves 120, 136 are inscribed. Hence, bore 144 is positioned to communicate with the arcuate passageway formed by groove 120 when control valve 100 is in the position shown in FIG. 4, and to communicate with the passageway formed with arcuate groove 136 when control valve 100 has rotated to the position shown in FIG. 5. As demonstrated in the drawing, groove 120 extends through an arc of about 200 degrees, while groove 136 extends through an arc of only about 90 degrees, hence bore 144 will communicate with groove 120 through about 200 degrees of rotation of cam 80. Bore 144 will communicate with groove 136 through only about 90 degrees of rotation. Bore 144 extends away from surface 108 to communicate with first chamber fluid line 146 that extends through housing 12 to first pumping chamber 36. Through line 146, pumping chamber 36 alternately communicates with first groove complex 118 (through arcuate groove 120) and second groove complex 130 (through groove 136).

An outlet bore 150 extends through wear plate 104 to connect the end portion of groove 122 at axis of rotation 124 with an outlet flow line 152 that extends through housing 12 to communicate with an outlet line (not shown) that delivers fluid from pump 10 through an orifice 153. Finally, a second pumping chamber bore 154 extends through plate 104 at a distance from axis 124 that is equal to the radius of the common circle on which grooves 120, 136 are formed. Hence, bore 154 is positioned to contact groove 136 when control valve 100 is in the position of FIG. 4, and alternately contact groove 120 when valve 100 is in the position shown in FIG. 5. In between these two positions, bore 154 will communicate with groove 120 through about 200 degrees of rotation of cam 80, and with groove 136 through about 90 degrees of cam rotation. Bore 154 communicates with a second pumping chamber passageway 156 that in turn extends through housing 12 to communicate with second pumping chamber 66.

Bores 140, 144, 150 and 154 are all aligned on a common diameter of the surface 108 of cylindrical valve member 102.

Figure 7:
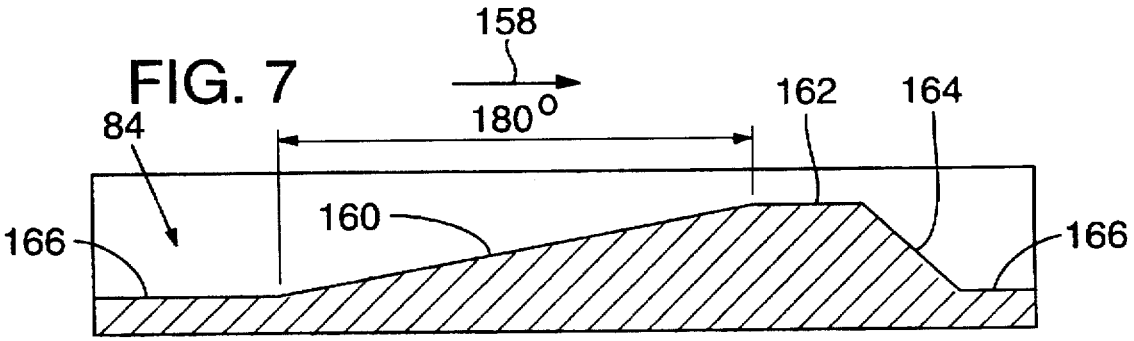
FIG. 7 is a schematic view of a continuous cross-section through a cam raceway of the operating cam of FIGS. 3–5, illustrating a groove configuration that controls the power stroke of each piston and permits precise, constant volumetric displacement of a small volume of liquid.

Assemblies 14, 16 operate by reciprocation of pistons 18, 48 as cam 80 rotates through a complete revolution around axis 90, and cam raceway groove 84 in bearing surface 82 moves the pistons in a specific, coordinated manner to provide a substantially constant volumetric flow rate of liquid through outlet line 152. Cam raceway 84 is shaped as shown in FIG. 7, wherein the cam raceway cross-section is shown as a longitudinal section to better illustrate the changing depth of the raceway throughout its circumference. The cam 80 rotates in a direction such that free ends of the pistons abut against and ride over the raceway in the direction of arrow 158. The pistons are spaced 180 degrees apart on the circular raceway, and have simultaneous movements that will be more fully detailed in FIG. 10.

The raceway has an upwardly inclined segment 160, followed by a horizontal segment 162 that is parallel to top surface 82 of cam 80, and then a downwardly inclined segment 164. A horizontal segment 166 is then followed by the upwardly sloping segment 160, as the continuous raceway circuit is completed and begins to repeat. Flat surface 166 is formed by the flat bottom surface of raceway 84. Upward incline 160 is longer and less steep than downwardly inclined surface 164.

Figure 10:
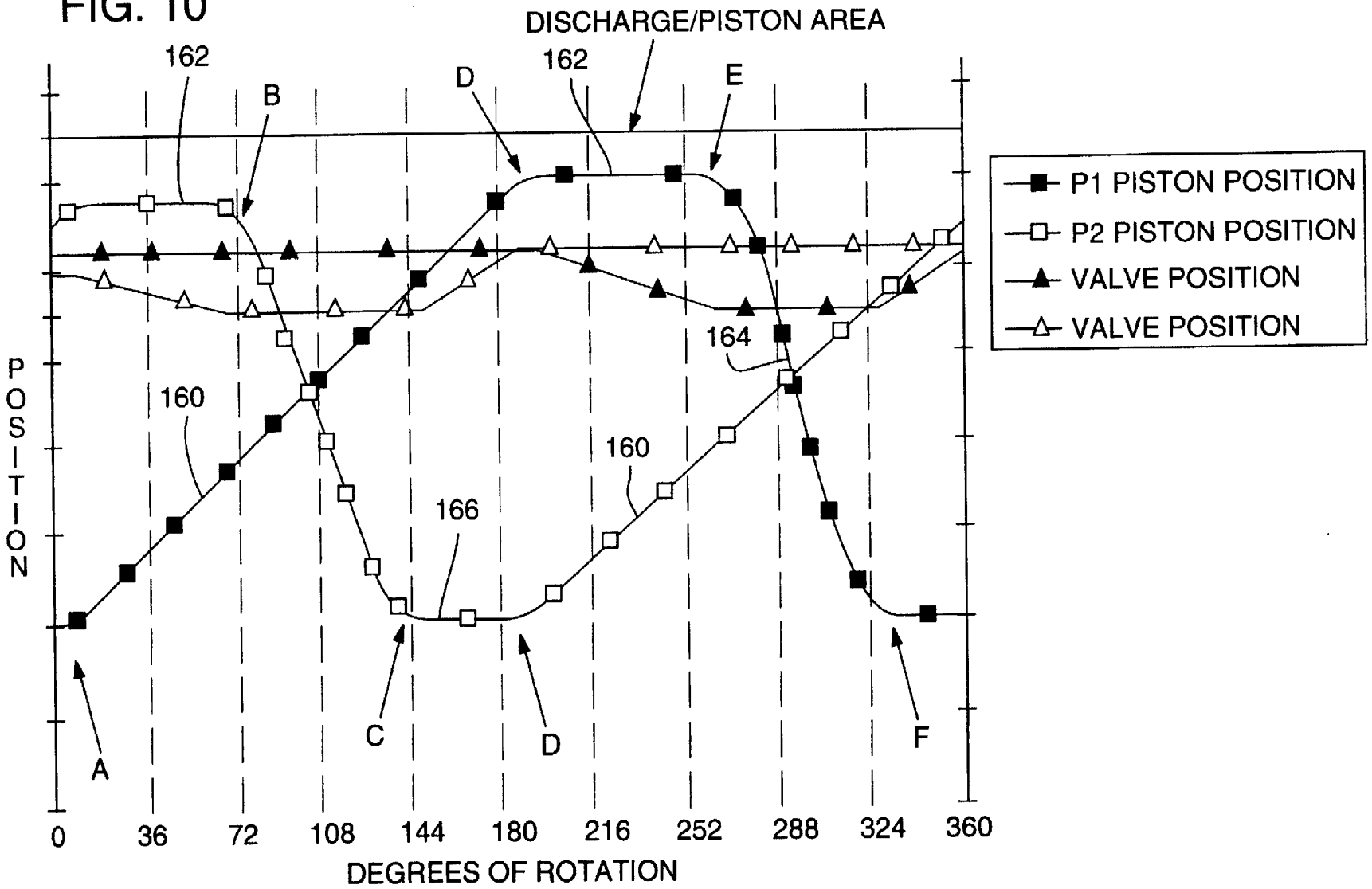
FIG. 10 is a graph showing the piston and valve positions of one embodiment of the pump, as the operating cam rotates through a 360 degree cycle.

The dimensional relationships of surfaces 160–166 are better illustrated in FIG. 10. The lines labeled P1 Position and P2 Position refer to the position of the first piston P1 (piston 18) and second piston P2 (piston 48), where the free end of each piston 18, 48 abuts the surface of raceway 84. Hence, the P1 and P2 position also traces the configuration of the raceway surface that moves the pistons. The segments 160–166 are therefore labeled on the graph of FIG. 10. Piston 18 (P1) has an initial upward displacement along raceway incline 160, followed by a period of zero displacement as the piston rides along flat raceway segment 162. Piston 18 then undergoes a steep downward displacement along surface 164, and then a period of zero displacement along flat bottom raceway segment 166. Piston 48 (P2) similarly has an upper period of zero displacement as it rides along top flat segment 162, followed by steep downward displacement along segment 164, then a period of zero displacement along flat bottom segment 166, followed by upward displacement along raceway incline 160. The movements of pistons 18, 48 are identical, but 180 degrees out of phase. Hence, second piston 48 (P2) reaches the position of flat segment 162 at about 5 degrees of rotation, while first piston 18 (P1) reaches that same position at 185 degrees.

The bearing surface in raceway 86 is shaped to accelerate the first piston 18 in a positive displacement direction (as bearing tip 23 rides up segment 160) through about 180 degrees of rotation to progressively reduce the volume of first pumping chamber 36 and force fluid out of that pumping chamber. Tip 23 of piston 18 then reaches the flat segment 162, which holds the positive displacement of the first piston 18 at a constant maximum displacement position through about 72 degrees of cam 80 rotation, during which fluid is neither drawn into nor expelled from chamber 36. Tip 23 then rides down over segment 164, to displace piston 18 (with the bias of spring 28) in a negative displacement direction through about 72 degrees of cam rotation until a maximum negative displacement position is reached as piston 18 arrives at segment 166 of groove 84. Piston 18 occupies constant negative displacement position 166 through about 36 degrees of cam rotation, during which fluid is neither drawn into nor expelled from chamber 36. During negative displacement of first piston 18, fluid is drawn into first pumping chamber 36 as that chamber volume expands.

The continuous impingement of the rotating annular control groove against both piston tips 23, 53 provides simultaneous movement of second piston 48 as first piston 18 is moving, but 180 degrees out of phase with each other, as shown in FIG. 10.

Displacement of the first piston 18 in the positive displacement direction along segment **160*a* begins at about 5 degrees rotation, as arbitrarily shown at A in FIG. 10. The beginning of positive displacement of first piston 18 coincides with second piston 48 first reaching it maximum positive displacement at segment 162. Displacement of first piston 18 in the positive displacement direction along segment 160 continues during the entire period in which the second piston 48 is in maximum positive displacement along segment 162. Positive displacement of piston 18 also continues while second piston 48 is displaced in the negative displacement direction as tip 53 moves along segment 164 (beginning at B), and reaches the maximum negative displacement position of the second piston at segment 166 (at C). Maximum constant positive displacement of first piston 18 begins as tip 23 initially rides on to segment 162 (at D), at the same time that displacement of the second piston 48** in the positive direction begins.

Displacement of first piston 18 in the negative displacement direction begins at E as tip 23 begins to ride down segment 164. Point E occurs about midway through displacement of the second piston 48 in the positive displacement direction (as tip 53 rides along segment 160). The first piston 18 reaches its maximum negative displacement position at F during the continued displacement of second piston 48 in the positive displacement direction. Hence, the period from E to F to A all occurs during the latter one-half of the positive displacement stroke of second piston 48 from D to A. Therefore, the period during which fluid is drawn into each piston is shorter than the period during which fluid is pumped out. In the disclosed embodiment, the period of pumping out is approximately three times longer than the period of pumping in.

Control valve 100 is fixed to and rotates with cam 80, about a common axis 90. As cam 80 rotates to actuate the piston pumps 14, 16, the control valve rotates to direct the flow of fluid through inlet and outlet paths. Control valve 100 moves between a first position shown in FIG. 5, and a second position shown in FIG. 4. In the first position (FIG. 5), fluid communication is established between the inlet line 142 and first pumping chamber 36 through passageway 146. Inlet line 142 communicates through bore 140 with groove 132, and passageway 146 communicates through bore 144 with groove 136 when the control valve is in the position shown in FIG. 5. Hence fluid can flow through the communicating passageways formed by grooves 132, 134 and 136 to establish fluid communication between inlet line 142 and chamber line 146. This fluid communication continues as long as bore 144 is above arcuate groove 136, and the arcuate shape of groove 136 maintains it below bore 140 through about one-quarter (90 degrees) of the rotation of control valve 100.

With the control valve in this same position (FIG. 5), outlet line 152 communicates through bore 150 with cross portion 122 at axis of rotation 124, and passageway 156 communicates through bore 154 with arcuate groove 120. Hence inlet line 152 communicates with second pumping chamber 66 through line 156 when the control valve is oriented as in FIG. 5. Continuous fluid communication is established because the passageways formed by grooves 120 and 122 are continuous, and interconnect lines 152, 156. Bore 150 is always positioned above center of rotation 124, and the passageway formed by groove 120 will remain positioned below bore 154 through about one-half rotation of control valve 100 because of the arcuate shape and length of the groove.

When control valve 100 rotates through 180 degrees around axis 90, it reaches the position shown in FIG. 4, at which time inlet line 142 is connected with second pumping chamber 66 through line 156, and first pumping chamber 36 is connected with outlet line 152. Inlet line 142 always communicates with groove 132 on control valve 100 through bore 140, because the continuous annular groove 132 forms a complete circle that is always positioned below bore 140 as control valve 100 rotates. In FIG. 4, line 142 is connected to second chamber 66 because line 156 communicates with groove 136 through bore 154. Grooves 132 and 136 are connected by groove 134, hence fluid flows through the passageways formed by grooves 136, 134 and 132 from inlet line 142 to pumping chamber 66.

With the control valve in the position shown in FIG. 4, outlet line 152 communicates with first pumping chamber 36. Inlet line 152 always communicates through bore 150 with groove 122 at center of rotation 124, throughout the entire rotation of control valve 100. Passageway 146 to first pumping chamber 36 communicates with groove 120 through bore 144 during the period of 90 degree rotation of cam 80, during which the arcuate groove 120 rotates beneath bore 144. Hence fluid may flow from pumping chamber 36, through line 146, into the passageway formed by groove 120, through cross portion 122, and through outlet line 152.

In operation, with control valve 100 in the position shown in FIG. 5, the cam raceway 84 on cam 80 is configured to negatively displace first piston 18 to draw fluid into first chamber 36 during the period in which lines 142 and 146 are connected by control valve 100 as groove 136 rotates beneath bore 144. During this same period, cam 80 moves second piston 48 in a positive displacement direction to force fluid out of second piston chamber 66 and through lines 156, 152 while groove 120 rotates beneath bore 154 for about 200 degrees of rotation of cam 80. Fluid will therefore be drawn into first pumping chamber 36 at the same time that fluid is forced out of second pumping chamber 66. The period during which groove 120 rotates beneath bore 154 is about twice as long as the period during which groove 136 rotates beneath bore 144, hence the period of drawing fluid into chamber 36 is about half as long as the period during which fluid is pumped out of chamber 66.

When the cam and control valve rotate to the position shown in FIG. 4, fluid is pumped through inlet line 142 into second pumping chamber 66, as second piston 48 is displaced downwardly by the force of spring 58 against piston 48. At the same time, fluid moves through line 146 into outlet line 152 as cam 80 displaces first piston 18 upwardly against the bias of spring 28 to reduce the volume of first pumping chamber 36. Fluid is therefore drawn into second pumping chamber 66 at the same time that fluid is forced out of first pumping chamber 36. The period during which groove 120 rotates beneath bore 144 is about twice as long as the period during which groove 136 rotates beneath bore 154. Hence, the period during which the control valve establishes fluid communication between lines 146 and 152 for outflow, is about twice as long as the period during which the control valve establishes fluid communication between lines 142 and 156 for inflow into chamber 66.

Figure 1:
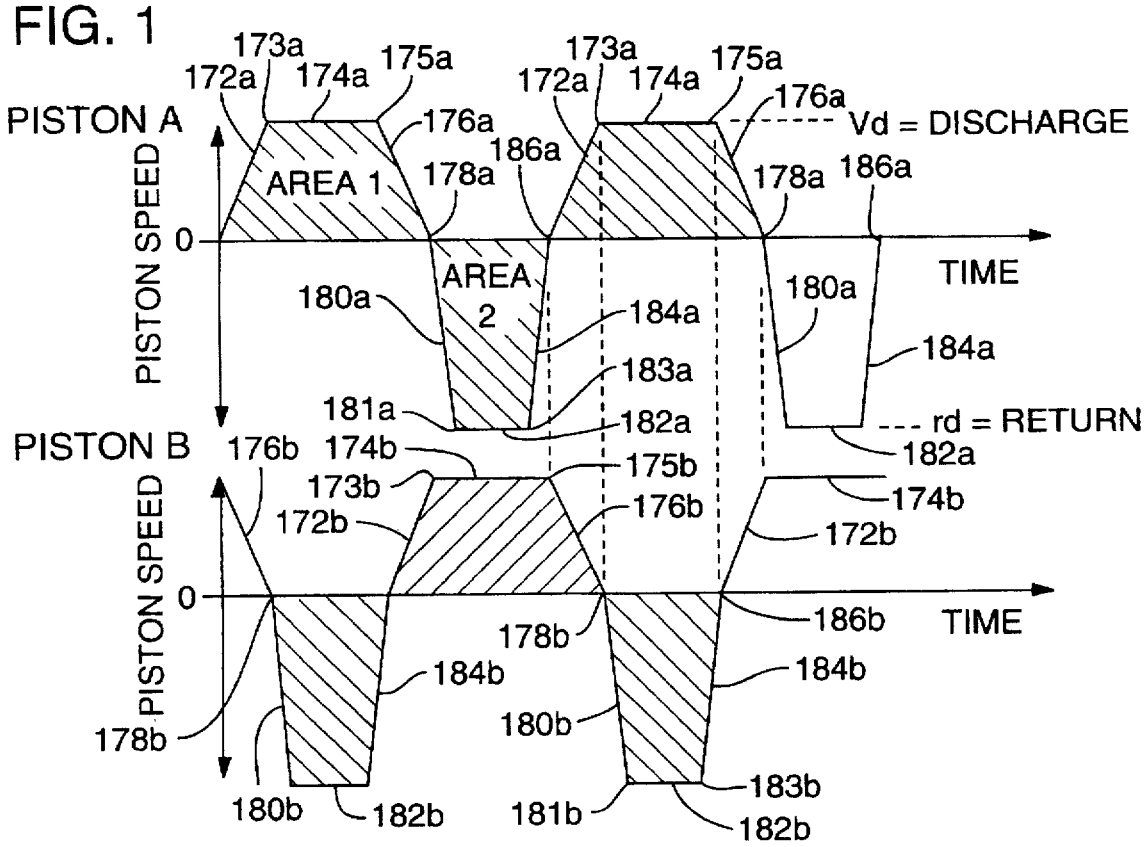
FIG. 1 is a graph showing piston speed versus time for the first piston (piston A) and second piston (piston B) of one embodiment of the dual piston pump, with the respective inputs and outputs of the two pistons shown within the curves of the graphs.
Figure 2:
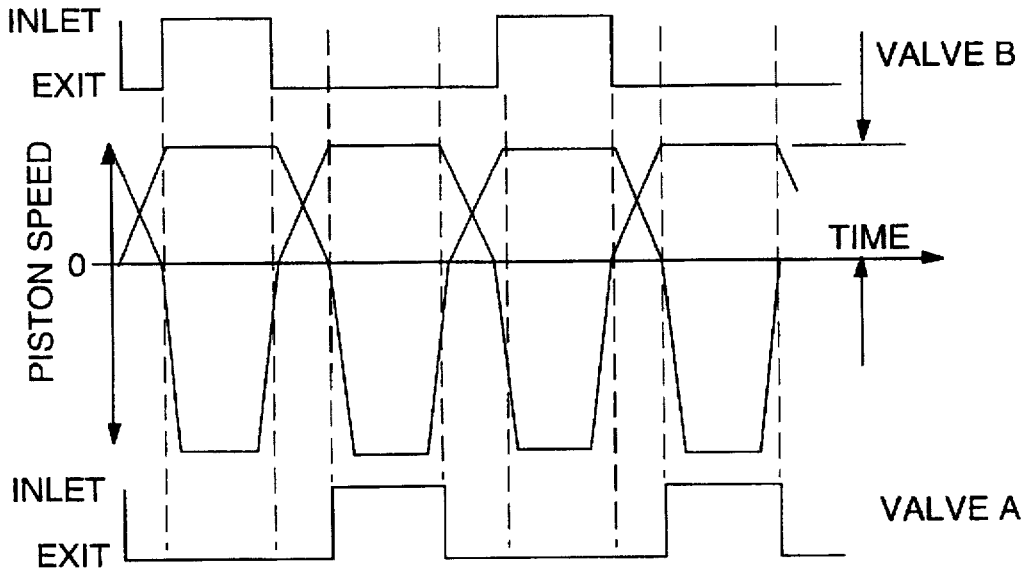
FIG. 2 is a graph similar to FIG. 1, but showing the superimposed inputs and outputs of pistons A and B in FIG. 1, and the corresponding position of the valve.

The effect of these superimposed, staggered inputs and outputs of varying duration from the first and second piston pumps 16, 18 is shown schematically in the graphs of FIGS. 1 and 2. FIG. 1 represents piston speed versus time, and the area enclosed within each graph is proportional to the volume of fluid displaced by each piston. Fluid output for first piston 18 is shown as Piston A, and fluid output for second piston 48 is shown as Piston B. Enclosed areas above the x-axis are volumes pumped out, while areas enclosed below the x axis are volumes drawn into the piston chamber. Piston A accelerates rapidly in an output power stroke **172*a* which begins to deliver fluid from pump 10, then at 173*a* achieves a substantially constant power stroke speed 174*a* for a period of time. At 175*a*, it slows rapidly along line 176*a* to a stop point at 178*a*. It then begins its return or input stroke at an even greater speed along line 180*a*, at 181*a* achieves a stable return stroke speed along line 182*a*, then at 183*a* slows rapidly along line 184*a* to a stop point 186*a***.

The graph for piston speed versus time of second piston pump 16 (Piston B) is similar, but is offset by 180 degrees along the time axis. Piston B accelerates rapidly in an output power stroke **172*b*, then at 173*b* achieves a substantially constant power stroke speed 174*b* for a period of time. At 175*b* it slows rapidly along line 176*b* to a stop point at 178*b*. It then begins its return stroke at an even greater speed along line 180*b*, achieves at 181*b* a stable return stroke speed along line 182*b*, then at 183*b* slows rapidly along line 184*b* to a stop point 186*b***.

A simplified schematic time relationship between the output power strokes and input strokes is shown by dotted lines in FIG. 1, which interconnect simultaneous time events for the two piston pumps 14, 16. Return strokes 180–184 occur more rapidly than output power strokes 172–178, such that output power strokes are able to partially overlap and superimpose their fluid outputs. This summation of outputs provides a substantially constant fluid output from the pump 10, as shown in FIG. 2. The output power stroke of Piston A begins at **186*a*, coincident with the time that the output power stroke of piston B begins to reverse at 175*b*. Acceleration to output power stroke along 172*a* coincides with the deceleration of the output stroke in Piston B. The entire period of the input power stroke 178*b*–186*b* then occurs, and takes the same amount of time as the constant velocity portion 174*a* of the output stroke of Piston A. Acceleration of the output stroke of Piston B along 172*b* then occurs in the same time that deceleration of the output stroke of Piston A occurs along 176*a*. The entire input stroke of Piston A (180*a*,182*a*,184*a*) then occurs during the same time that constant velocity portion 174*b* of output stroke for Piston B occurs. In this manner, the output strokes of Pistons A and B overlap, as shown in FIG. 2, to provide a substantially constant flow rate from pump 10**.

Figure 8:
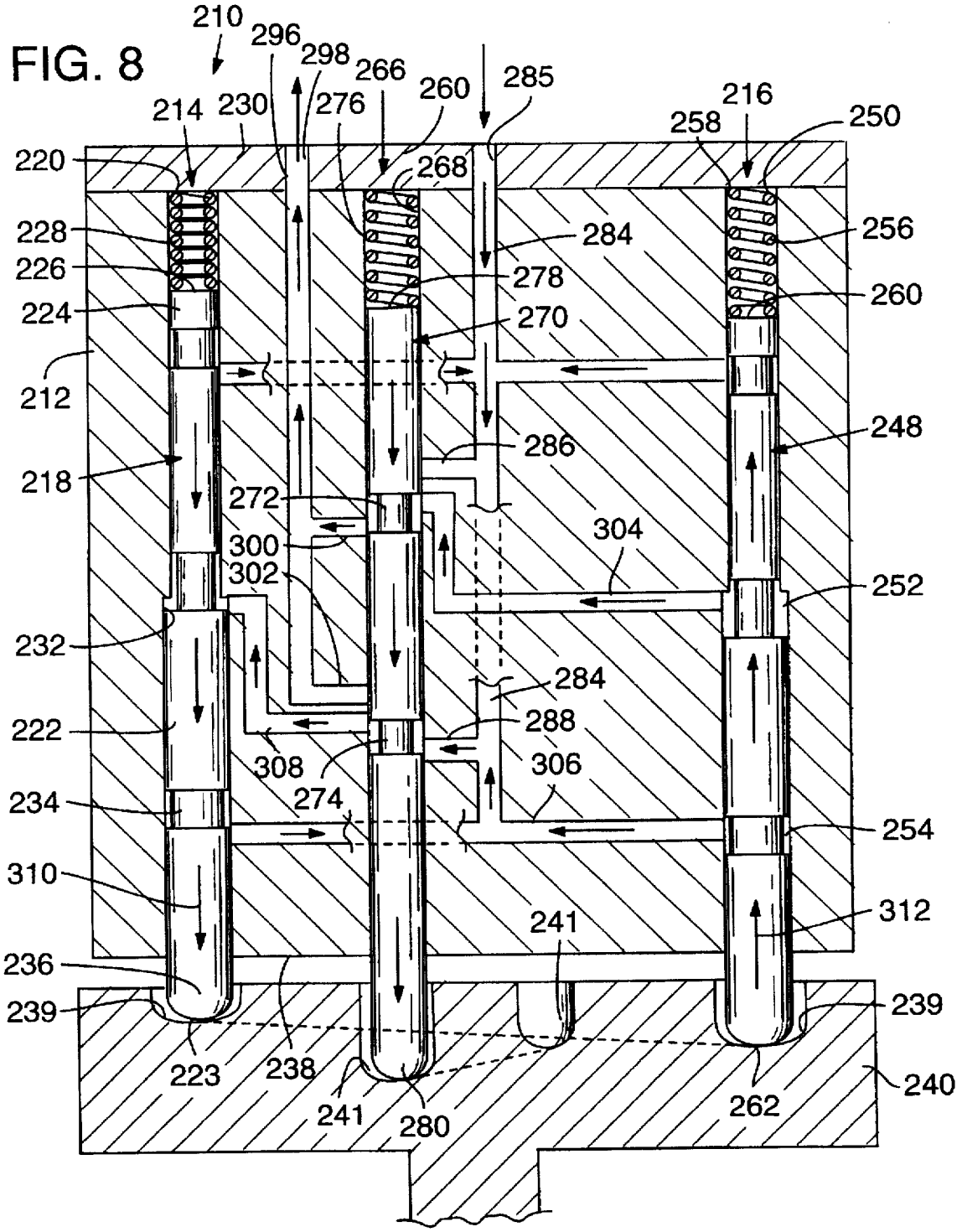
FIG. 8 is a schematic cross-sectional view of a second embodiment of a pump, in which the control valve is a spool valve in a first position.
Figure 9:
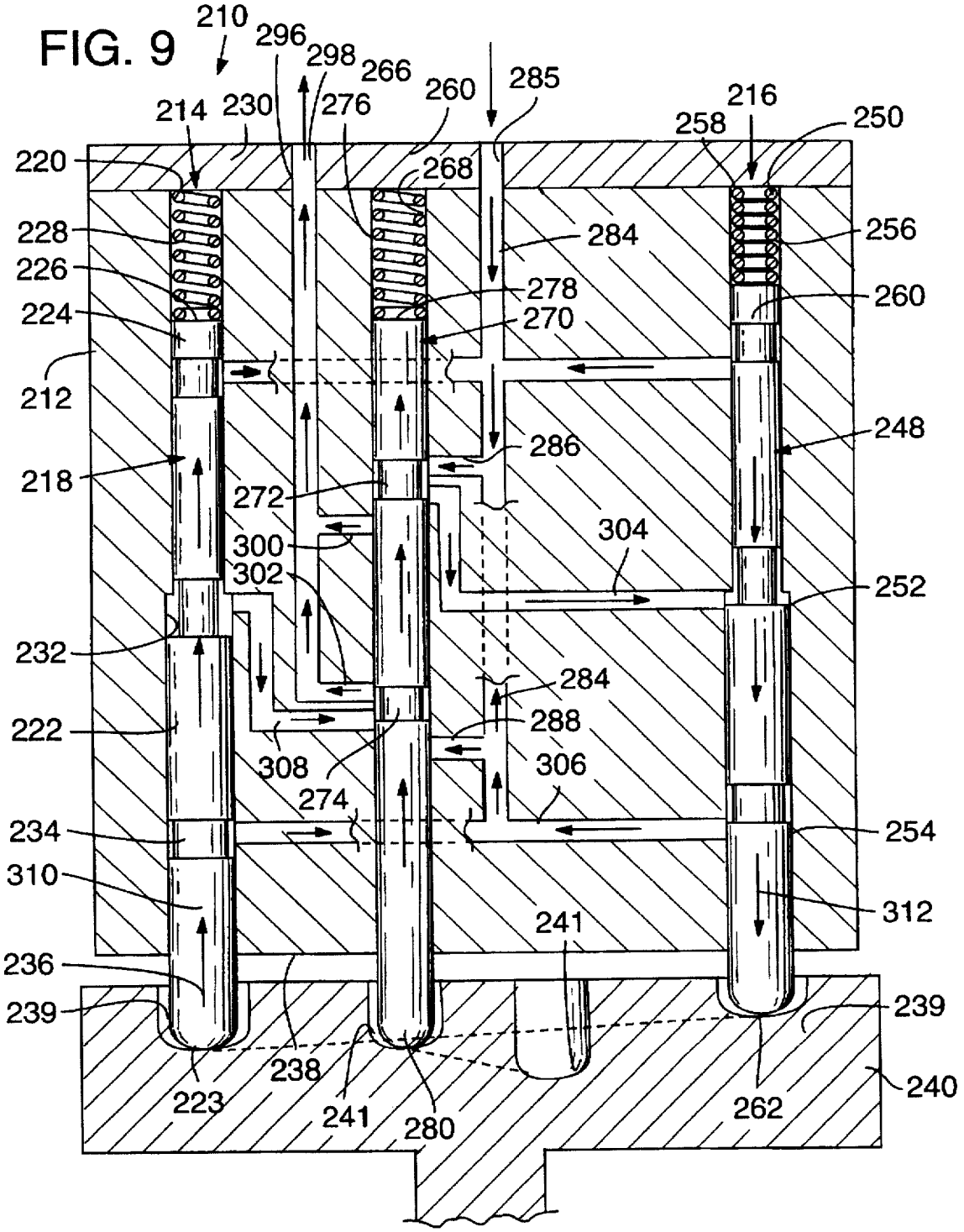
FIG. 9 is a view of the piston pump of FIG. 8, but in which the control valve has been moved to a second position.

A second embodiment of the invention is shown in FIGS. 6, 8 and 9, in which the control valve is a spool valve. As in the earlier described embodiment, pump 210 is capable of substantially pulseless delivery of a fluid, such as liquid water. The pump includes a housing 212 that contains first piston assembly 214 and second piston assembly 216. First piston assembly 214 includes a reciprocating first piston 218 in a first piston bore 220. Piston 218 has a first large diameter portion 222 with a rounded bearing tip 223, and a second large diameter portion 224, with a flat top surface 226. Piston 218 is capable of reciprocating in bore 220 against the bias of a helical spring 228 that seats against and extends between a housing cover 230 and surface 226 of piston 218.

Figure 6A:
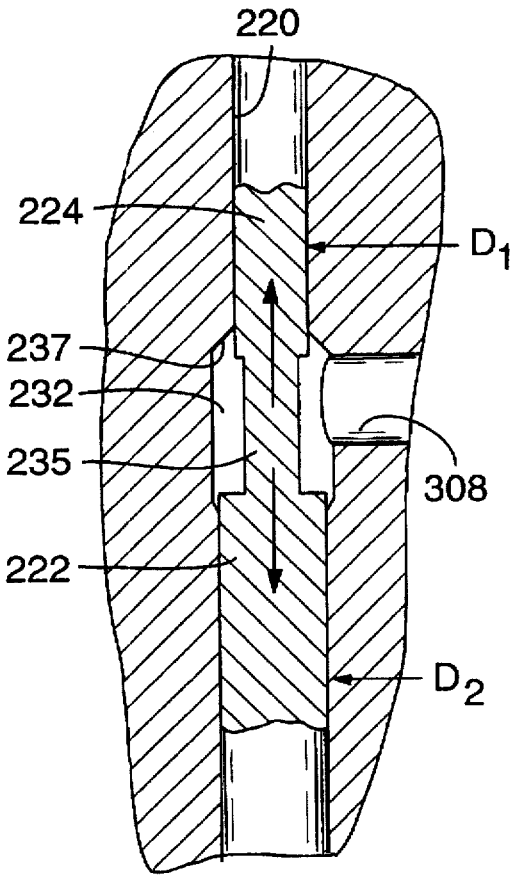
FIG. 6A is an enlarged, cross-sectional view through one of the piston bores illustrating the differential piston area that is proportional to volumetric displacement.
Figure 6B:
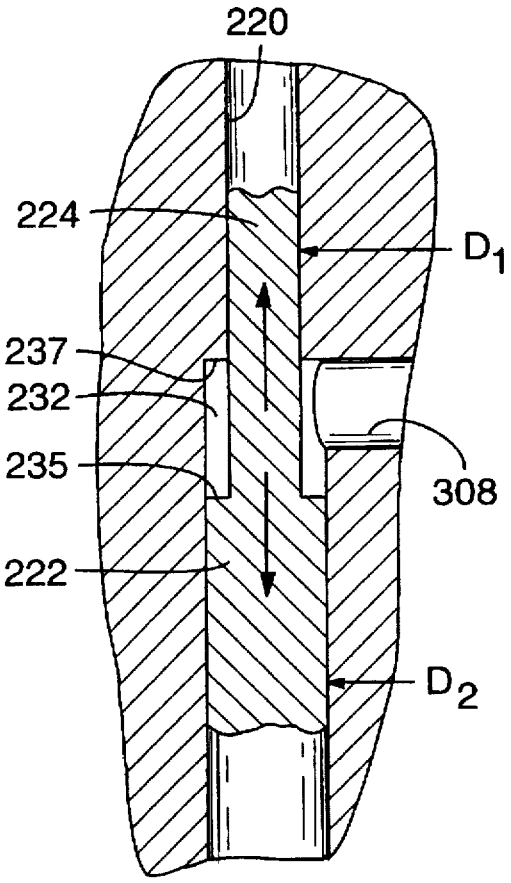
FIG. 6B is an alternative pumping chamber embodiment.

A series of pumping chambers 232, 234 are located along piston 218, and are formed by necked down diameter portions of the piston. FIG. 6A illustrates a representative pumping chamber 232 in which portions 222, 224 of piston 218 meet at necked down portion 235. A clearance seal circumscribes portion 224, and a clearance seal circumscribes portion 222, delimiting chamber 232 therebetween to form chamber 232. Hence, chamber 232 varies in volume as piston 218 reciprocates in the bore. An alternative embodiment of the pumping chamber is shown in FIG. 6B wherein portion 222 necks down to a portion 224 that then reciprocates in a narrower diameter piston bore.

A bearing end of piston 218 extends beyond a bottom surface 238 of housing 212 and engages raceway 239 in a cam 240, similar to the cam 80 discussed in connection with an earlier embodiment. The cam has the same principle of operation as the cam 80, at least with respect to reciprocation of pistons 218, 248, and it will not be described again. The surface of the cam raceway 239 is the same as the surface configuration of raceway 84.

Second piston assembly 216 is similar to piston assembly 214 described above. Second piston assembly 216 includes a reciprocating piston 248 in second piston bore 250. Piston 248 has a series of necked down portions that form chambers 252 and 254. Piston 248 is capable of reciprocating in bore 250 against the bias of a helical spring 258 that seats against and extends between housing cover 230 and surface 260 of piston 218. A bearing end 262 of piston 248 extends beyond the bottom surface 238 of housing 212 and engages raceway 239.

A spool valve 266 is provided in a bore 268 that extends through housing 212 parallel to bores 220, 250. Bore 268 is offset from the longitudinal axis of housing 212. The spool valve includes a reciprocating piston 270 in bore 268. Piston 270 has two necked down portions that form chambers 272, 274 that provide flow paths through spool valve 266. Piston 270 is capable of reciprocating in bore 268 against the bias of a helical spring 276 that seats against and extends between housing cover 230 and surface 278 of piston 270. A bearing end 280 of piston 270 extends beyond the bottom surface 238 of housing 212 and engages a cam raceway 241, which reciprocates piston 270 in a manner described below.

An inlet line 284 opens at an orifice 285 on the exterior of housing 212, and line 284 extends through the housing parallel to spool valve bore 268, and between spool valve 266 and second piston 248. Communicating fluid lines 286, 288 extend from inlet line 284 to spool valve bore 268. Line 286 communicates with chamber 272 when the spool valve is in the position shown in FIG. 9, but not when the spool valve is in the position shown in FIG. 8. Line 288 is positioned to communicate with chamber 274 when the spool valve is in the position shown in FIG. 8, but not when the spool valve is in the position shown in FIG. 9.

An outlet fluid line 296 extends through the housing 212 parallel to spool valve bore 268, and opens through the exterior of housing 212 at orifice 298. Lines 300, 302 extend from line 296 to spool valve bore 268. Line 300 communicates with chamber 272 when the spool valve is in the position shown in FIG. 8, but not when the spool valve is positioned as in FIG. 9. Line 302 communicates with chamber 274 when the spool valve is in the position shown in FIG. 9, but not when the spool valve is in the position shown in FIG. 8.

Lines 304, 306 communicate between chambers 252, 254 and chambers 272, 274. Line 304 always communicates with chambers 252 and 272, at all times throughout reciprocation of spool valve 270. Line 306 always communicates with chamber 254, but only communicates with chamber 274 when the spool valve is in the position shown in FIG. 8. Line 306 thereby serves as a fluid leak line to redirect fluid, that bleeds past clearance seals, back into the pump. Another line 308 communicates between chamber 274 and chamber 232. Line 308 always communicates with chambers 274 and 232 as the spool valve reciprocates.

In operation, cam 240 moves the pistons 214, 248 and spool valve piston 270 between the positions shown in FIGS. 8 and 9. Referring first to FIG. 9, in which the spool valve is in the position shown, piston 248 is moving down while piston 218 is moving up. Fluid flows from a supply source (not shown) through orifice 285 into lines 284 and 286. Fluid in line 284 is able to communicate with line 304 through chamber 272 with which both lines 284, 304 communicate. With the spool valve in this position, simultaneous downward movement of piston 248 creates a negative pressure that draws fluid through line 284, 286, chamber 272, and into line 304 and chamber 252.

Simultaneous with the drawing of fluid into chamber 252 in FIG. 9, piston 218 is moving upwardly and forcing fluid out of its chamber 232. As chamber 232 diminishes in volume, fluid is forced out of chamber 232, through line 308, chamber 274, and into lines 302, 296. Hence fluid within chamber 232 is expelled through outlet 298 while new fluid is drawn in through inlet 285 into chamber 252.

Cam 240 is continuously rotating through repeated 360 degree rotations during operation of the valve 210, and the bearing surface of the cam has a pair of concentric raceways 239, 241 that move the pistons of the valve by impinging against their ends 236, 262 and 280. After cam 240 rotates through 180 degrees from the position shown in FIG. 9, the pistons 218, 248 and 270 are in the position shown in FIG. 8, with spool valve piston 270 having moved down, piston 218 moving downwardly in the direction of arrow 310, and piston 248 moving upwardly in the direction of arrow 312.

With the pistons arranged as in FIG. 8, fluid still moves in through line 284, but it can no longer communicate with chamber 252 because spool valve 270 has moved downwardly from the position it occupied in FIG. 9. Instead, fluid moves through inlet line 284, into line 288, thence to spool valve chamber 274 and into chamber 232 through line 308. The piston 218 is moving down, hence supplying negative pressure in chamber 232 that draws fluid into chamber 232 from inlet line 284.

Simultaneous with movement of fluid into chamber 232 (FIG. 8), upward movement of the other piston 248 is expelling fluid from chamber 252. As piston 248 moves up, positive pressure in that chamber forces fluid out through line 304, which communicates with chamber 272, that in turn communicates with lines 300 and 296. Fluid forced out by chamber 252 is expelled through outlet orifice 298.

Cam 240 continues to rotate, and after a further 180 degree rotation from that shown in FIG. 8, will once again assume the configuration shown in FIG. 9. The continuous upward and downward movement of piston 218, 248, with the varying position of spool valve 266, provides for a continuous flow of fluid out of the valve. The outputs and inputs of pistons 218, 248 will follow the pattern shown in FIG. 1, and the superimposed flows of the two pistons will provide a substantially uniform flow output, as demonstrated in FIG. 2.

Line 306 is a fluid leak return line that helps diminish the amount of liquid that leaks out of the pump. Liquid can seep past the clearance seals around chamber 252. The seeping liquid will reach chamber 254, and be directed back into the inlet line through line 306. Other leak lines are shown in FIGS. 8 and 9 (for example from chamber 234), and their function is the same as line 306.

Figure 11:
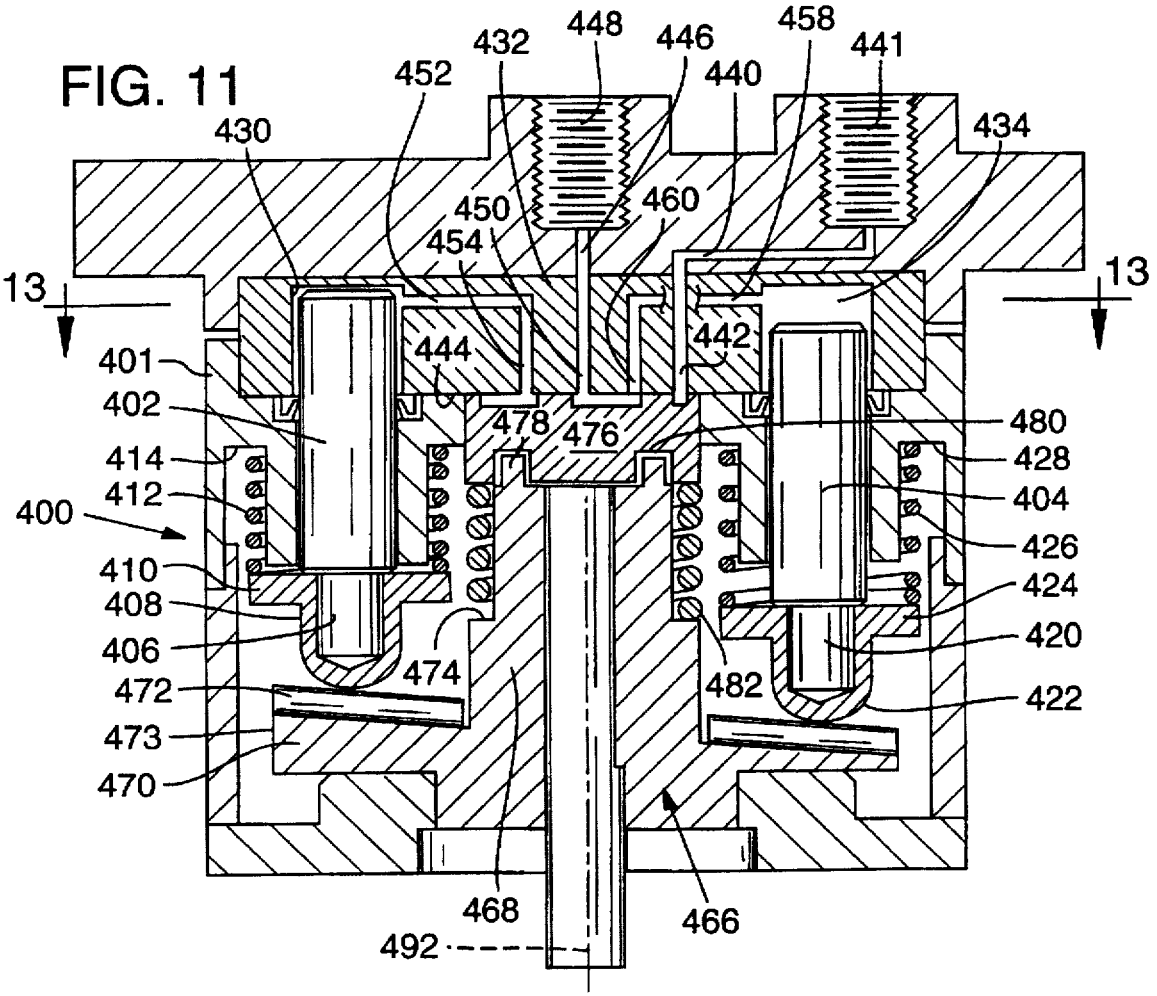
FIG. 11 is a cross-sectional view of another embodiment of the pump, in which the bearing surface of the cam is a slanted, annular wobble plate.

Another embodiment of the invention is shown in FIG. 11, wherein a pump 400 in housing 401 includes a first piston 402 and a second piston 404 that reciprocate in their respective piston bores. A tip 406 of piston 402 has a bearing cap 408 with a circumferential collar 410 that is spring biased by spring 412 that seats against and extends between collar 410 and an interior ledge 414 of housing 401. A tip 420 of piston 404 similarly has a bearing cap 422 with a circumferential collar 424 that is spring biased by spring 426 that seats against and extends between collar 424 and an interior ledge 428 of housing 401.

Piston 402 communicates with a pumping chamber 430 in a control plate 432 that is part of housing 401, while piston 404 communicates with a pumping chamber 434 that is also in control plate 432. The control plate forms the inner end of the bore in which each piston reciprocates, and each pumping chamber is formed by a recess in the plate 432 that forms the inner portion of the piston bore. An inlet flow path 440 is formed through the control plate 432 and the wall of housing 401 between an external inlet opening 441 and an orifice 442 opening on an inner control surface 444 of the control plate 432. An outlet flow path 446 is formed through control plate 432 and a wall of housing 401 between an external outlet opening 448 and an orifice 450 opening on inner surface 444 of plate 432. A pumping chamber flow path 452 extends through control plate 432 of housing 401 from pumping chamber 430 to an orifice 454 opening on inner surface 444. Another pumping chamber flow path 458 extends through the control plate 432 to an orifice 460 opening on inner surface 444. Orifices 454, 460 are on a common circle.

A rotary cam 466 is positioned in housing 401, and includes a central post portion 468 that projects away from a surrounding circumferential bearing collar 470. The bearing collar 470 is inclined at a constant angle of about 15 degrees to the axis of rotation of cam 466. An annular wobble plate 472 with a smooth top surface is positioned on top of collar 470 to provide a bearing surface that impinges against bearing caps 408, 422. As cam 466 rotates, impingement of the wobble plate against the caps 408, 422 reciprocates the pistons. The bearing surface of plate 472 rotates around an axis of rotation 492 of the cam 466. The bearing surface of plate 472 is non-circumferential, that is it is not on the curved circumferential face 473 of the collar 470. The non-circumferential bearing surface is instead in a plane that intersects axis of rotation 492. Axis 492 preferably extends substantially parallel to pistons 402, 404, and through a control member 476 discussed below.

The central post 468 of cam 466 includes a top cylindrical portion that extends between an annular shoulder 474 and a disc-shaped control member 476. The post 468 has an annular ridge 478 that fits within a complementary annular indentation in a bottom face of control member 476. A spring 482 extends around post 468 between shoulder 474 and a bottom surface of control member 476 to force member 476 tightly against control plate 432. Tight engagement between the control plate 432 and disc-shaped control member 476 establishes fluid tight passageways between the plate 432 and grooves that form channels inscribed in a control surface 484 of member 476.

Figure 12:
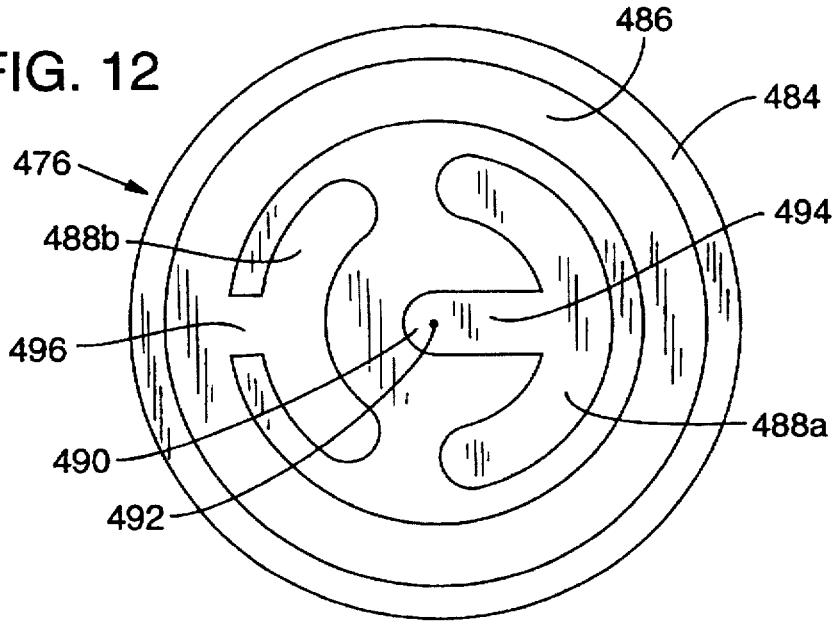
FIG. 12 is a view of the control surface carried by the cam, in which grooves have been inscribed to form fluid passageways in cooperation with an overlying control plate.

FIG. 12 shows the control surface of member 476. The control surface has a continuous annular outer channel 486 that circumscribes an inner channel 488. Inner channel 488 is discontinuous, and includes a first arc shaped inner channel portion **488*a* and a second arc shaped inner channel portion 488*b*. The portions of the channel 488 both run along a common circle, but the portions 488*a*, 488*b* are interrupted so that they do not communicate with each other. In the embodiment of claim 12, portion 488*b* extends along approximately 170 degrees of the circle, while portion 488*a* extends along approximately 170 degrees of the common circle. The channel portions 488*a*, 488*b* are symmetric mirror images of each other. Discontinuity between channel portions 488*a*, 488*b* prevent fluid communication between these channels. In other embodiments, a completely circular inner channel 488 can be provided, but with occlusions within the channel that break the channel into discrete channel segments. In yet other embodiments, the channels may be asymmetric, for example portion 488*a* extending along approximately 180 degrees of the common circle, and the portion 488*b*** extending along approximately 120 degrees.

A localized, indentation 490 is located on control surface 484 along the axis of rotation 492 of cam 466. A first communicating channel 494 extends between and connects the localized indentation 490 and the first arc shaped channel portion **488*a*. A second Communicating channel 496 extends between second arc shaped channel portion 488*b* and outer channel 486**.

Figure 13:
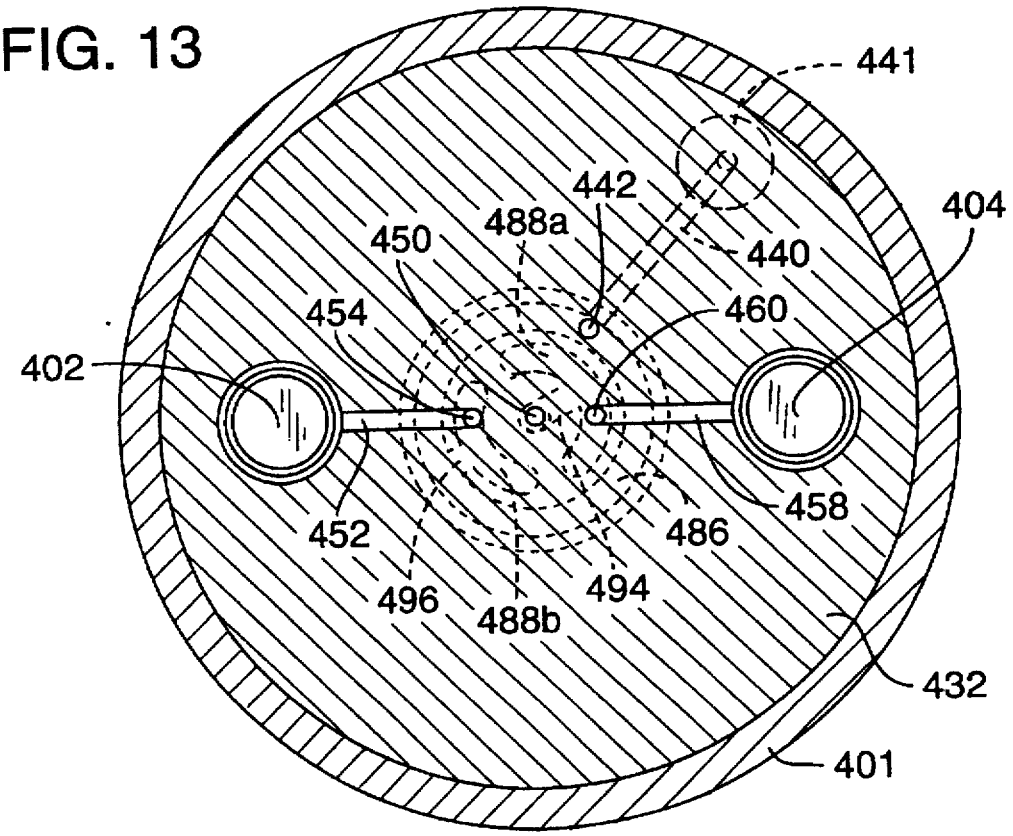
FIG. 13 is a cross-sectional view, taken along view line 13—13 in FIG. 11, but with the cam rotated counterclockwise from the position shown in FIG. 12.

The stationary control plate 432 fits against control surface 484 to convert the channels into closed fluid passageways. The orifices in control plate 432 are positioned to establish and break fluid connections as cam 466 rotates, as best shown in FIG. 13. When the cam is in the position shown in that drawing, orifice 450 is centered around axis of rotation 492, and aligned over indentation 490. This alignment is maintained throughout rotation of cam 466 so that fluid communication between indentation 490 and outlet flow path 446 is always present. Similarly, orifice 442 is aligned over channel 486 so that inlet flow path 440 is always in communication with the passageway formed by channel 486 throughout rotation of cam 466.

Orifice 454 is aligned over the circle on which inner channel 488 lies. In FIG. 13, orifice 454 communicates with arc **488*b* to establish fluid connection between arc 488*b* and the flow path 452 leading to pumping chamber 430. Orifice 460 communicates with arc 488*a* to establish fluid connection between arc 488*a* and the flow path 458 leading to pumping chamber 434. Communication between orifice 454 and arc 488*b* continues throughout approximately 170 degrees of rotation of cam 460, while orifice 460 communicates with arc 488*a* throughout approximately 170 degrees of cam rotation. As rotation of cam 466 and control surface 484 continues, orifice 454 will then communicate with arc 488*a* and not 488*b* through about 170 degrees of cam rotation, while orifice 460 will communicate with arc 488*b* and not 488*a*** through about 170 degrees of cam rotation.

Orifices 454, 460 are in a common circle overlying the annular path of channel 488.

As cam 466 rotates, wobble plate 472 also reciprocates spring biased pistons 402, 404. The constant slope (both in the negative and positive directions) of the bearing surface of wobble plate 472 provides a substantially constant velocity of each piston as it reciprocates in each direction. The two pistons are 180 degrees apart, hence the pistons 402, 404 reciprocate approximately 180 degrees out of phase. For example with the cam in the position shown in FIG. 13, as piston 404 moves into chamber 434, it pumps fluid out of chamber 434 through pathway 458 and orifice 460, through arc 488*a*, pathway 494, orifice 450, and outlet flow pathway 446. Simultaneously, the other piston 402 is moving out of chamber 430, to draw fluid into the chamber from inlet 441, which communicates with flow path 440 through orifice 442, channels 486, 496, 488*b*, orifice 454 and flow path 452. Rotation of the cam 466 (for example a 180° rotation from that shown in FIG. 13) reverses these relationships, such that as piston 402 subsequently reciprocates into chamber 430, fluid flows out of the chamber through path 452, orifice 454, arc 488*a*, segment 494, orifice 450, and outlet flow path and opening 448. Similarly, reciprocation of piston 404 away from chamber 434 will draw fluid in through pathway 458, orifice 460, arc 488*b*, segment 496, outer channel 486, orifice 442, pathway 440 and inlet opening 441.

Figure 14:
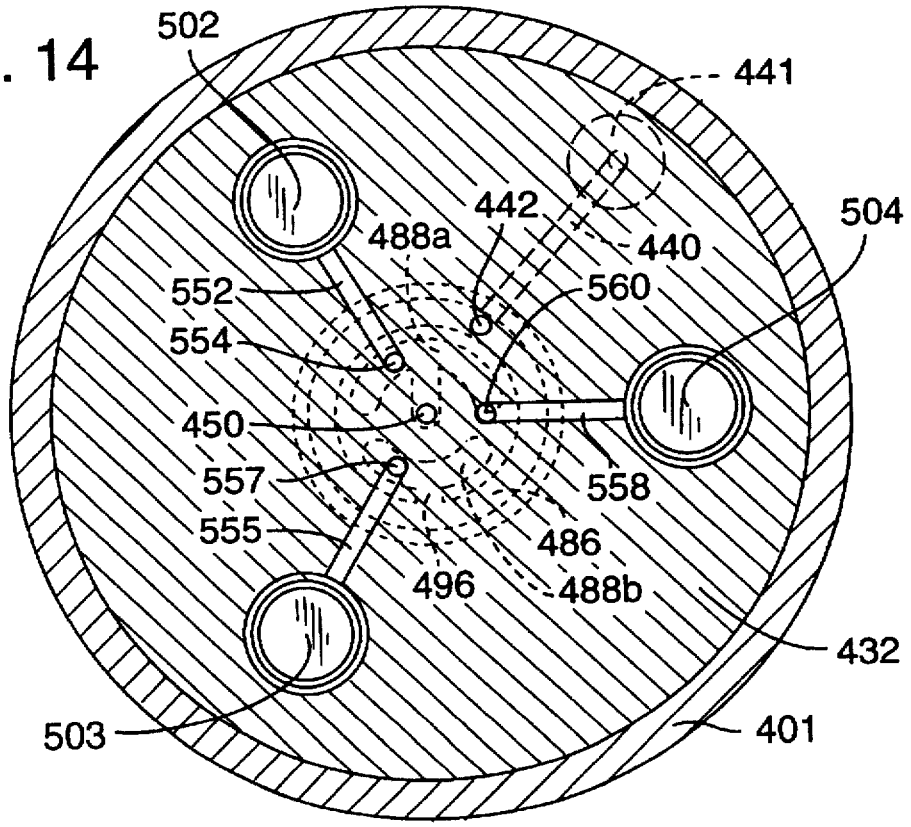
FIG. 14 is a view, similar to FIG. 13, of a three piston embodiment of the pump.

Another embodiment of the piston pump is shown in FIG. 14, wherein like parts have been given like reference numerals to the embodiment shown in FIG. 13, with the exception of the pistons and the orifices with which they communicate. This embodiment of the multiple piston pump has three pistons, which are designated 502, 503 and 504, which respectively communicate through flow paths 552, 555, 558 with orifices 554, 557 and 560 in control plate 432. Each of these orifices is positioned on a circle below which inner channel 488 extends, so that the orifices will be in communication with either arcs 488*a* or 488*b* at different times throughout cam 466 rotation. The addition of additional pistons in this manner can decrease pulsation in outflow from the pump by summing the simultaneous outflow of multiple pistons.

A particular advantage of the three piston embodiment is that it reduces pulsation of flow from the pump. This is an advantage that persists with other pumps in accordance with the present invention that have an odd number of pistons, for example three, five or seven pistons.

Although the disclosed embodiments show inflow through opening 441 and outflow through opening 448, the inflow and outflow can be reversed so that opening 441 is an outflow and opening 448 is an inflow. The flow of fluid through the pump would them be reversed.

Pulsations of flow from the pump can also be further reduced by controlling cam rotation speed over the course of rotation. The rotational speed can be increased at times of decreased flow output, and decreased at times of increased flow output.

Having illustrated and described the principles of the invention in several preferred embodiments, it should be apparent to those skilled in the art that the invention can be modified in arrangement and detail without departing from such principles. Therefore, the illustrated embodiments should be considered only as preferred examples of the invention and not as a limitation on the scope of the claims. We therefore claim as our invention all modifications and equivalents to the illustrated embodiments coming within the scope and spirit of following claims.

We claim:

1. A pump for delivery of a fluid, comprising:

first and second reciprocating pistons, wherein the first piston communicates with a first pumping chamber, and the second piston communicates with a second pumping chamber;

a rotary cam that reciprocates the pistons as the cam rotates;

an inlet flow path that communicates with the first pumping chamber when the first piston is reciprocating in a direction that draws fluid into the first pumping chamber, and with the second pumping chamber when the second piston is reciprocating in a direction that draws fluid into the second pumping chamber;

an outlet flow path that communicates with the first pumping chamber when the first piston is reciprocating in a direction that expels fluid out of the first pumping chamber, and with the second pumping chamber when the second piston is reciprocating in a direction that expels fluid out of the second pumping chamber;

a control surface carried by the cam, wherein the control surface alternately moves between a first position and a second position, and flow channels are inscribed in the control surface, wherein when the control surface is in the first position the inlet flow path to the first pumping chamber is continuous through the flow channels and the outlet flow path from the first pumping chamber is interrupted, and the inlet flow path to the second pumping chamber is interrupted and the outlet flow path from the second pumping chamber is continuous through the flow channels, and when the control surface is in the second position the inlet flow path to the second pumping chamber is continuous through the flow channels and the outlet flow path from the second pumping chamber is interrupted, and the inlet flow path to the first pumping chamber is interrupted and the outlet flow path from the first pumping chamber is continuous through the flow channels.

2. The pump of claim 1 wherein the cam moves the first and second pistons such that the first piston expels fluid when the second piston is drawing fluid in, and the first piston draws in fluid while the second piston expels fluid, and the cam further moves the control valve between the first and second positions, with the control valve in the first position when the first piston draws in fluid and the second piston expels fluid, and the control valve in the second position when the first piston expels fluid and the second piston draws in fluid.

3. The pump of claim 1 wherein the cam rotates around an axis that is substantially parallel to the first and second pistons.

4. The pump of claim 1 wherein the cam control surface has a variable shape that reciprocates the pistons.

5. The pump of claim 1 wherein the control surface impinges against and reciprocates the pistons, which are spring biased against the cam surface, and the control surface also moves the control valve between the first position and the second position of the control valve.

6. The pump of claim 4 wherein the variable shape of the surface is provided by a raceway in the surface of the cam.

7. The pump of claim 4 wherein the variable shape of the control surface is a slanted surface.

8. The pump of claim 6 wherein the raceway has a surface that reciprocates the first piston faster in the direction that draws fluid into the first pumping chamber than in the direction that expels fluid out of the first pumping chamber, and the surface of the raceway reciprocates the second piston faster in the direction that draws fluid into the second pumping chamber than in the direction that expels fluid out of the second pumping chamber.

9. The pump of claim 1 wherein the control surface is a variable shaped surface that reciprocates the first and second pistons as the cam rotates, and the control surface is rotated by the cam, wherein the control surface has a plurality of grooves inscribed therein that establish passageways through which the control valve directs the flow of the fluid to establish the continuous and interrupted flow paths when the control valve is in the first and second positions.

10. The pump of claim 9 wherein the plurality of grooves comprise:

a first annular groove in communication with one of the inlet or outlet flow path throughout rotation of the cam;

a second groove that is coincident with an inner circle circumscribed by the first groove;

an indentation on the axis of rotation of the cam that, throughout rotation of the cam, is in communication with the inlet or outlet flow path that is not in communication with the first annular groove;

wherein the second groove comprises a first groove portion and a second groove portion that are discontinuous with each other, and the first and second groove portions alternately communicate with the first and second pumping chambers as the control surface rotates;

a first connecting groove that connects the first groove portion of the second groove with the indentation on the axis of rotation; and a second connecting groove that connects the second groove portion of the second groove with the first annular groove.

11. The pump of claim 10 wherein the control surface apposes a control plate that cooperatively with the grooves forms the passageways, and the control plate includes a plurality of openings therethrough that establish communication between the passageways and the inlet and outlet flow pathways, and between the passageways and the first and second pumping chambers.

12. A pump for continuous delivery of a fluid, comprising:

an inlet flow path through which fluid is delivered to the pump;

an outlet flow path through which fluid is delivered from the pump;

a plurality of reciprocating pistons, wherein each piston communicates with a pumping chamber to draw fluid from the inlet flow path into the pumping chamber as the piston moves in a first direction, and to force fluid out of the pumping chamber through the outlet flow path as the piston moves in a second direction;

a rotary cam that rotates around an axis of rotation and reciprocates the pistons as the cam rotates;

a control surface carried by the cam and intersected by the axis of rotation, wherein flow control channels are inscribed in the control surface, and the flow control channels comprise:

a continuous annular outer channel;

a discontinuous annular inner channel circumscribed by the outer continuous annular channel and forming a first arc shaped inner channel portion and a second arc shaped inner channel portion;

a localized indentation at the center of rotation of the cam;

a first communicating channel between the localized indentation and the first arc shaped inner channel portion;

a second communicating channel between the outer channel and the second arc shaped inner channel portion;

separate pumping chamber flow paths communicating between the continuous outer annular channel and each of the pumping chambers;

a stationary control plate that fits against the control surface to form closed passageways between the control plate and the channels in the control surface, wherein the control plate has a first opening through the control plate positioned to communicate with the continuous annular outer channel and one of the inlet flow path or outlet flow path throughout rotation of the control surface;

a second opening through the control plate positioned to communicate, throughout rotation of the control surface, with the localized indentation and the one of the inlet flow path or outlet flow path that does not communicate with the annular outer channel; and a plurality of pumping chamber openings positioned to communicate between the pumping chamber flow paths and the inner channel on the control surface.

13. The pump of claim 12 wherein the rotary cam has a raceway with a patterned surface over which the pistons ride to reciprocate as the cam rotates.

14. The pump of claim 12 wherein the rotary cam has a slanted surface that impinges against a bearing end of the pistons to reciprocate the pistons as the cam rotates.

15. The pump of claim 12 wherein the plurality of reciprocating pistons comprises an odd number of reciprocating pistons.

16. The pump of claim 15 wherein the odd number of reciprocating pistons is three reciprocating pistons.

17. A pump for substantially pulseless delivery of a fluid, comprising:

a housing containing first and second spring biased piston assemblies, the first piston assembly comprising a first piston bore with a first reciprocating piston disposed in the first piston bore, and a first pumping chamber in the first piston bore, the second piston assembly comprising a second piston bore with a second reciprocating piston disposed in the second piston bore, and a second pumping chamber in the second piston bore;

a rotary cam that reciprocates the pistons as the cam rotates;

an inlet flow path through the housing and that communicates with the first pumping chamber when the first piston is reciprocating in a direction that draws fluid into the first pumping chamber, and with the second pumping chamber when the second piston is reciprocating in a direction that draws fluid into the second pumping chamber;

an outlet flow path through the housing that communicates with the first pumping chamber when the first piston is reciprocating in a direction that expels fluid out of the first pumping chamber, and with the second pumping chamber when the second piston is reciprocating in a direction that expels fluid out of the second pumping chamber;

a control surface carried by the cam, wherein the control surface alternately moves between a first position and a second position, and flow channels are inscribed in the control surface wherein when the control surface is in the first position the inlet flow path to the first pumping chamber is continuous through the flow channels and the outlet flow path from the first pumping chamber is interrupted, and the inlet flow path to the second pumping chamber is interrupted and the outlet flow path from the second pumping chamber is continuous through the flow channels, and when the control surface is in the second position the inlet flow path to the second pumping chamber is continuous through the flow channels, and the outlet flow path from the second pumping chamber is interrupted, and the inlet flow path to the first pumping chamber is interrupted and the outlet flow path from the first pumping chamber is continuous through the flow channels; and wherein a bore axis for each piston bore is substantially parallel, and each reciprocating piston is reciprocated by the cam as the cam rotates around an axis parallel to the bore axis for each piston, and the cam moves the first and second pistons such that the first piston expels fluid when the second piston is drawing fluid in, and the first piston draws in fluid while the second piston expels fluid, and the cam further moves the control surface between the first and second positions, with the control surface in the first position when the first piston draws in fluid and the second piston expels fluid, and the control surface in the second position when the first piston expels fluid and the second piston draws in fluid.

18. The pump of claim 17 wherein the cam has an impingement surface shaped to impinge the pistons, and the impingement surface is shaped to reciprocate the pistons such that the fluid delivery of the pump is substantially constant.

19. The pump of claim 18 wherein the impingement surface is shaped to displace each piston in a positive displacement direction away from a neutral position to expel fluid from the pumping chamber, followed by a reversal of piston direction to a negative displacement direction that draws fluid into the pumping chamber, and the period of time during which negative displacement of each piston occurs is less than the period of time during which positive displacement of each piston occurs, and the positive displacements of the first and second pistons are in staggered phases, such that the output flow of the first and second pistons superimpose to provide a substantially continuous fluid flow from the pump.

20. The pump of claim 19 wherein the cam moves at a constant rotational speed and is shaped to displace the first piston in the positive displacement direction in which fluid is forced out of the first pumping chamber, then hold the positive displacement of the first piston at a constant maximum displacement position, then displace the first piston in the negative displacement direction until a maximum negative displacement position is reached;

the cam is further shaped to displace the second piston in the positive displacement direction in which fluid is forced out of the second pumping chamber, then hold the positive displacement at a constant maximum positive displacement position, then displace the second piston in the negative displacement direction until the maximum negative displacement is reached;

displacement of the first piston in the positive displacement direction begins when the second piston first reaches its maximum positive displacement, and displacement of the first piston in the positive displacement direction continues during the entire period during which the second piston is displaced in the negative displacement direction and reaches the maximum negative displacement position of the second piston, the maximum positive displacement position of the first piston is reached as the maximum negative displacement of the second piston ends and displacement of the second piston in the positive direction begins;

displacement of the first piston in the negative displacement direction begins during displacement of the second piston in the positive displacement direction, and the first piston reaches it maximum negative displacement position during the displacement of the second piston in the positive displacement direction.

21. The pump of claim 19 wherein the control surface comprises a valve member having a control surface with the flow channels inscribed therein, and a cover over the flow channels such that the flow channels and cover form closed fluid passageways therebetween, and in the first position of the control valve, the fluid passageways of the control valve establish fluid communication between the inlet and the first pumping chamber and the outlet and the second pumping chamber, and in the second position the valve member establishes fluid communication between the inlet and the second pumping chamber, and the outlet and the first pumping chamber.

22. The pump of claim 21 wherein the control surface rotates relative to the cover, and the cover has openings therethrough that communicate with the fluid passageways.

23. The pump of claim 19 wherein the control surface is part of a control valve comprising a control disc and the control surface is flat, and a cover with a flat inside face bears against the control surface, wherein the disc rotates relative to the cover about an axis of rotation, and flow channels in the control surface form, in cooperation with the overlying cover, an inlet passageway and an outlet passageway that do not communicate with each other;

first, second, third and fourth bores extending through the cover, wherein the first bore is an inlet bore that communicates with the inlet line, the second bore is an outlet bore that communicates with the outlet line, the third bore communicates with a flow path to the first pumping chamber, and the fourth bore communicates with a flow path to the second pumping chamber;

wherein the inlet passageway comprises an annular inlet passageway circumscribing an arcuate inlet passageway, and the annular and arcuate inlet passageways both have the same center and radius of curvature, and a communicating passageway extends radially on the control surface between the annular and arcuate passageways, and the outlet passageway comprises an arcuate outlet passageway with a center of curvature at the axis, and a communicating arm that extends from the arcuate outlet passageway to the center of curvature of the arcuate outlet passageway, and the distance from the axis of the arcuate inlet and outlet passageways is the same; and wherein the second bore extends through the cover at the axis to communicate with the arm of the outlet passageway, the distance between the axis and first bore is the same as the distance from the axis to the annular inlet passageway, and the distance between the axis and the third and fourth bores is the same as the radius from the axis to the arcuate inlet and outlet passageways.

24. The pump of claim 19 wherein the control valve comprises a spool valve disposed for axial movement in a spool valve bore in the housing with the spool valve bore axis substantially parallel to the bore axes of the pistons, and the spool valve has first and second necked down portions, with fluid communication between the inlet and the first pumping chamber being established through the first necked down portion when the spool valve is in the first position, fluid communication between the outlet and the second pumping chamber being established through the second necked down portion when the spool valve is in the first position, fluid communication between the inlet and the second pumping chamber being established through the second necked down portion when the spool valve is in the second position, and fluid communication between the outlet and the first pumping chamber being established through the first necked down portion when the spool valve is in the second position.

25. A pump for substantially pulseless delivery of a fluid, comprising:

a housing containing first and second piston pump assemblies, the first piston pump assembly comprising a first spring biased reciprocating piston in a first piston bore, and a first pumping chamber formed in the first piston bore, the second piston pump assembly comprising a second spring biased reciprocating piston in a second piston bore, and a second pumping chamber formed in the second piston bore, the first and second piston bores having axes that are substantially parallel;

a control valve in the housing that moves between a first and a second position, wherein the control valve has a first passageway connecting portion and a second passageway connecting portion;

an inlet line into the housing that communicates with the control valve;

an outlet line from the control valve out of the housing;

a first pumping chamber passageway from the first pumping chamber to the control valve;

a second pumping chamber passageway from the second pumping chamber to the control valve;

a cam that moves at a constant rotational speed and impinges against the first and second pistons to move the first piston against its spring bias to force fluid out of the first pumping chamber, and subsequently allows the first piston to move with its spring bias to draw fluid into the first pumping chamber, and the cam further moves the second piston against its spring bias to force fluid out of the second pumping chamber, and subsequently allows the second piston to move with its spring bias to draw fluid into the second pumping chamber;

where the cam has an axis of rotation that is substantially parallel to the axes of the first and second piston bores, and movement of the cam further moves the control valve between (a) a first position in which fluid communication is established between the inlet line and the first pumping chamber passageway through the first passageway connecting portion, as well as between the second pumping chamber passageway and the outlet line through the second passageway connecting portion, while blocking fluid communication between the outlet line and the first pumping chamber passageway, and the inlet line and the second pumping chamber passageway; and (b) a second position of the control valve in which fluid communication is established between the inlet line and the second pumping chamber passageway through the second passageway connecting portion, as well as between the outlet line and the first pumping chamber passageway, while blocking fluid communication between the outlet line and the second pumping chamber passageway, and the inlet line and the first pumping chamber passageway;

wherein the cam is shaped to displace the first piston in a positive displacement direction in which fluid is forced out of the first pumping chamber, then hold the positive displacement of the first piston at a constant maximum displacement position, then displace the first piston in a negative displacement direction until a maximum negative displacement position is reached, and during the negative displacement of the first piston fluid is drawn into the first pumping chamber;

the cam is further shaped to displace the second piston in a positive displacement direction in which fluid is forced out of the second pumping chamber, then hold the positive displacement at a constant maximum positive displacement position, then displace the second piston in a negative displacement direction until the maximum negative displacement is reached, and during the negative displacement of the second piston fluid is drawn into the second pumping chamber;

displacement of the first piston in the positive displacement direction begins when the second piston first reaches its maximum positive displacement, and displacement of the first piston in the positive displacement direction continues during the entire period during which the second piston is displaced in the negative displacement direction and reaches the maximum negative displacement position of the second piston, the maximum positive displacement position of the first piston is reached as the maximum negative displacement of the second piston ends and displacement of the second piston in the positive direction begins;

displacement of the first piston in the negative displacement direction begins during displacement of the second piston in the positive displacement direction, and the first piston reaches it maximum negative displacement position during the displacement of the second piston in the positive displacement direction; and wherein the control valve is a member that rotates with the cam about a common axis, and the member has a generally epsilon-shaped passageway with an arcuate back and a straight cross portion that extends toward and terminates in a terminus at the axis of rotation of the member, and the epsilon-shaped passageway is circumscribed by an annular passageway with a side-arm passageway extending from the annular passageway towards the epsilon-shaped passageway, and the side-arm passageway terminates in an arcuate passageway that is on a common circle with the arcuate back of the epsilon-shaped passageway, further wherein the annular passageway is always in fluid communication with the inlet line, and the outlet line is always in fluid communication with the arcuate back of the terminus of the cross portion of the epsilon shaped passageway, and when the control valve is in the first position the first pumping chamber passageway is in fluid communication with arcuate passageway and the second pumping chamber passageway is in fluid communication with the arcuate back of the epsilon shaped passageway, and when the control valve is in the second position the first pumping chamber passageway is in fluid communication with the arcuate back of the epsilon shaped passageway, and the second pumping chamber passageway is in fluid communication with the arcuate passageway.

26. The pump of claim 25 wherein the control valve is a member that rotates with the cam about a common axis, and the member has a generally epsilon-shaped passageway with an arcuate back and a straight cross portion that extends toward and terminates in a terminus at the axis of rotation of the member, and the epsilon-shaped passageway is circumscribed by an annular passageway with a side-arm passageway extending from the annular passageway towards the epsilon-shaped passageway, and the side-arm passageway terminates in an arcuate passageway that is on a common circle with the arcuate back of the epsilon-shaped passageway, further wherein the annular passageway is always in fluid communication with the inlet line, and the outlet line is always in fluid communication with the arcuate back of the terminus of the cross portion of the epsilon shaped passageway, and when the control valve is in the first position the first pumping chamber passageway is in fluid communication with arcuate passageway and the second pumping chamber passageway is in fluid communication with the arcuate back of the epsilon shaped passageway, and when the control valve is in the second position the first pumping chamber passageway is in fluid communication with the arcuate back of the epsilon shaped passageway, and the second pumping chamber passageway is in fluid communication with the arcuate passageway.

27. The pump of claim 26, further comprising a fluid leak return chamber formed in one of the first or second piston bores, and a fluid leak return line communicating with the fluid leak return chamber, wherein the fluid leak return chamber collects fluid that seeps out of the first or second pumping chambers, and returns the fluid to one of the first or second pumping chamber passageways.

28. A pump for delivery of a fluid, comprising:

first and second reciprocating pistons, wherein the first piston communicates with a first pumping chamber, and the second piston communicates with a second pumping chamber;

an inlet flow path that communicates with the first pumping chamber when the first piston is reciprocating in a direction that draws fluid into the first pumping chamber, and with the second pumping chamber when the second piston is reciprocating in a direction that draws fluid into the second pumping chamber;

an outlet flow path that communicates with the first pumping chamber when the first piston is reciprocating in a direction that expels fluid out of the first pumping chamber, and with the second pumping chamber when the second piston is reciprocating in a direction that expels fluid out of the second pumping chamber;

a control valve that alternately moves between a first position and a second position, wherein when the control valve is in the first position the inlet flow path to the first pumping chamber is continuous and the outlet flow path from the first pumping chamber is interrupted, and the inlet flow path to the second pumping chamber is interrupted and the outlet flow path from the second pumping chamber is continuous, and when the control valve is in the second position the inlet flow path to the second pumping chamber is continuous and the outlet flow path from the second pumping chamber is interrupted, and the inlet flow path to the first pumping chamber is interrupted and the outlet flow path from the first pumping chamber is continuous; and wherein each reciprocating piston is reciprocated by a cam having a bearing face, the cam moves the control valve between the first and second positions of the control valve, and the cam has a variable shaped surface that reciprocates the first and second pistons as the cam rotates, and the control valve comprises a control surface rotated by the cam, wherein the control surface has a plurality of grooves inscribed therein that establish passageways through which the control valve directs the flow of the fluid to establish the continuous and interrupted flow paths when the control valve is in the first and second positions; and wherein the plurality of grooves comprise:

a first annular groove in communication with one of the inlet or outlet flow path throughout rotation of the cam;

a second groove that is coincident with an inner circle circumscribed by the first groove;

an indentation on the axis of rotation of the cam that, throughout rotation of the cam, is in communication with the inlet or outlet flow path that is not in communication with the first annular groove;

wherein the second groove comprises a first groove portion and a second groove portion that are discontinuous with each other, and the first and second groove portions alternately communicate with the first and second pumping chambers as the control surface rotates;

a first connecting groove that connects the first groove portion of the second groove with the indentation on the axis of rotation; and a second connecting groove that connects the second groove portion of the second groove with the first annular groove.

* * * * *

UNITED STATES PATENT AND TRADEMARK OFFICE

CERTIFICATE OF CORRECTION

PATENT NO. : 5,733,105
DATED : March 31, 1998
INVENTOR(S) : Carl D. Beckett, Kevin D. O'Hara, Daniel B. Olsen, Steven E. Soar and Glenn E. Siemer It is certified that error appears in the above-identified patent and that said Letters Patent is hereby corrected as shown below:

Column 2,
Line 21, change "form" to read -- from --.

Column 4,
Line 65, change "fits Within" to -- within fits --.

Column 8,
Line 30, change "it maximum" to -- its maximum --.

Column 14,
Line 24, change "prevent fluid" to -- prevents fluid --.
Line 37, change "second Communicating" to -- second communicating --.

Column 15,
Line 51, change "would them be" to -- would then be --.

Column 18,
Line 14, change "plate has" to -- plate has: --.

Column 20,
Line 10, change "it" to -- its --.

Column 22,
Line 37, change "it" to -- its --.

Signed and Sealed this

Fifth Day of February, 2002

*Attest:*

*Attesting Officer*

JAMES E. ROGAN
*Director of the United States Patent and Trademark Office*